US010081899B2

(12) United States Patent
Seo et al.

(10) Patent No.: US 10,081,899 B2
(45) **Date of Patent: *Sep. 25, 2018**

(54) PORTABLE LAUNDRY TREATING APPARATUS

(71) Applicant: LG Electronics Inc., Seoul (KR)

(72) Inventors: Bosung Seo, Seoul (KR); Junghoon Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 134 days.

This patent is subject to a terminal disclaimer.

(21) Appl. No.: 14/293,917

(22) Filed: Jun. 2, 2014

(65) Prior Publication Data

US 2014/0352365 A1 Dec. 4, 2014

(30) Foreign Application Priority Data

Jun. 3, 2013 (KR) ..... 10-2013-0063298
Jun. 3, 2013 (KR) ..... 10-2013-0063299
Jun. 3, 2013 (KR) ..... 10-2013-0063300

(51) Int. Cl.
*D06F 35/00* (2006.01)
*D06F 39/02* (2006.01)
*D06F 43/00* (2006.01)

(52) U.S. Cl.
CPC ..... *D06F 35/00* (2013.01); *D06F 39/02* (2013.01); *D06F 43/002* (2013.01)

(58) Field of Classification Search
CPC ..... D06F 39/02; D06F 35/00; D06F 43/00; D06F 43/002; D06B 1/02
USPC ..... 15/321; 68/17 R
See application file for complete search history.

(56) References Cited

U.S. PATENT DOCUMENTS 3,562,844 A 2/1971 Thompson et al.
3,721,026 A 3/1973 McCallum
3,883,301 A * 5/1975 Emrick ..... A47L 11/34 15/321
4,926,514 A * 5/1990 Leuenberger ..... D06F 43/002 15/321
6,347,428 B1 2/2002 Shimko et al.
6,550,098 B2 * 4/2003 Roberts ..... A47L 1/08 15/320
7,478,455 B2 1/2009 Heim
8,329,112 B2 12/2012 Gibis et al.
2002/0073504 A1 6/2002 Hall et al.
(Continued)

FOREIGN PATENT DOCUMENTS

CN 1606645 A 4/2005
CN 2818524 Y 9/2006
(Continued)

*Primary Examiner* — Rita P Adhlakha
(74) *Attorney, Agent, or Firm* — Birch, Stewart, Kolasch & Birch, LLP

(57) ABSTRACT

A hand-held laundry treating apparatus includes a portable body, a supply tank including a tank body provided at the portable body, a water chamber provided in the tank body to store water therein and a detergent chamber provided in the tank body to store detergent therein, a suction tank including a suction chamber provided at the portable body to store liquid therein, and a liquid transferring part for supplying liquid stored in the supply tank to laundry and transferring liquid remaining in laundry to the suction tank.

13 Claims, 12 Drawing Sheets

(56) References Cited

U.S. PATENT DOCUMENTS

| | | | |
|---|---|---|---|
| 2005/0069302 | A1 | 3/2005 | Wong et al. |
| 2006/0185402 | A1 | 8/2006 | Wang |

FOREIGN PATENT DOCUMENTS

| | | | |
|---|---|---|---|
| CN | 1981944 | A | 6/2007 |
| CN | 201040803 | Y | 3/2008 |
| DE | 296 12 960 | U1 | 1/1997 |
| EP | 0 325 192 | A1 | 7/1989 |
| EP | 2 172 587 | A2 | 4/2010 |
| JP | 5-7696 | A | 1/1993 |

* cited by examiner ( a )

( b )

(a)

(b)

(a)

(b)

PORTABLE LAUNDRY TREATING APPARATUS

This application claims the benefit of Korean Patent Application No. 10-2013-0063298, filed on Jun. 3, 2013, Korean Patent Application No. 10-2013-0063299, filed on Jun. 3, 2013, and Korean Patent Application No. 10-2013-0063300, filed on Jun. 3, 2013, which are hereby incorporated by reference as if fully set forth herein.

BACKGROUND OF THE INVENTION

Field of the Invention

The present invention relates to a portable laundry treating apparatus.

Discussion of the Related Art

In general, a laundry treating apparatus is a machine for removing various kinds of dirt from laundry by using a softening action of detergent, frictional force and impact of water circulation caused by rotation of a pulsator (or drum).

A conventional laundry treating apparatus includes a tub in which wash water is received and a drum which is rotatably provided in the tub and in which laundry is received. Such a conventional laundry treating apparatus performs a laundry washing operation by putting laundry into the drum, supplying wash water into the tub and rotating the drum.

However, even when only a portion of laundry is contaminated with dirt (i.e., laundry is contaminated locally), laundry should be put into the tub in which wash water is received (i.e., whole laundry should be immersed in wash water). Therefore, the above-described conventional laundry treating apparatus is inappropriate to remove dirt from laundry contaminated locally.

SUMMARY OF THE INVENTION

Accordingly, the present invention is directed to a portable laundry treating apparatus that substantially obviates one or more problems due to limitations and disadvantages of the related art.

An object of the present invention is to provide a portable laundry treating apparatus for removing dirt from laundry contaminated locally.

Another object of the present invention is to provide a portable laundry treating apparatus capable of spraying at least any one of detergent and wash water onto laundry and also sucking liquid from laundry.

Another object of the present invention is to provide a portable laundry treating apparatus that is small enough to be used or operated while being held in the hand of an operator.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve the object and other advantages and in accordance with the purpose of the invention, as embodied and broadly described herein, a portable laundry treating apparatus comprises: a portable body; a supply tank in which at least any one of water and detergent is stored; a suction tank for providing a space in which liquid is stored; and a liquid transferring part for supplying liquid stored in the supply tank to laundry and transferring liquid remaining in laundry to the suction tank.

Also, there is provided a portable laundry treating apparatus comprising: a portable body; a supply tank removably coupled to the portable body to store at least any of water and detergent therein; a suction tank removably coupled to the portable body to provide a space for storing liquid therein; and a liquid transferring part for supplying liquid stored in the supply tank to laundry and transferring liquid remaining in laundry to the suction tank.

Also, there is provided a portable laundry treating apparatus comprising: a portable body; a supply tank in which at least any one of water and detergent is stored; a nozzle part by which the supply tank communicates with the outside; and a liquid transferring part communicating with the nozzle part to discharge liquid stored in the supply tank to the outside of the nozzle part by decreasing an internal pressure of the nozzle part.

Also, there is provided a portable laundry treating apparatus comprising: a portable body; a first chamber provided at the portable body to store any one of water and detergent therein; a tank body provided at the portable body; a second chamber provided in the tank body to provide a space for storing the other one of water and detergent therein; a suction tank provided in the tank body and including a suction chamber for providing a space to store liquid therein; and a liquid transferring part for supplying liquid stored in the first chamber and the second chamber to laundry and transferring liquid remaining in laundry to the suction tank.

Also, there is provided a portable laundry treating apparatus comprising: a portable body; a supply tank including a tank body provided at the portable body, a water chamber provided in the tank body to store water therein and a detergent chamber provided in the tank body to store detergent therein; a suction tank removably coupled to the portable body and including a suction chamber to store liquid therein; and a liquid transferring part for supplying liquid stored in the supply tank to laundry and transferring liquid remaining in laundry to the suction tank.

Also, there is provided a portable laundry treating apparatus comprising: a portable body; a liquid storage part including a tank body provided at the portable body, a water chamber provided in the tank body to store water therein; a detergent chamber provided in the tank body to store detergent therein and a suction chamber provided in the tank body to provide a space for storing liquid therein; and a liquid transferring part for supplying liquid stored in the water chamber and the detergent chamber to laundry and transferring liquid remaining in laundry to the suction chamber.

As is apparent from the above description, the portable laundry treating apparatus can remove dirt from laundry contaminated locally.

Further, the portable laundry treating apparatus can spray at least any one of detergent and wash water onto laundry and also can suck liquid from laundry.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Figure 1:
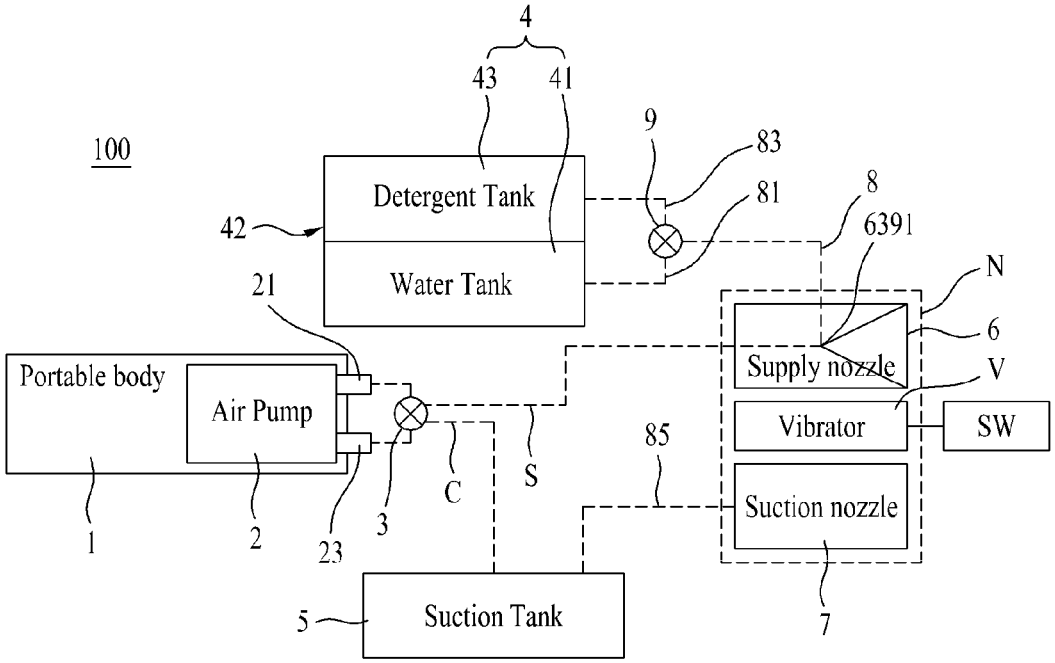
FIG. 1 is a view illustrating a portable laundry treating apparatus according to the present invention.
Figure 1:
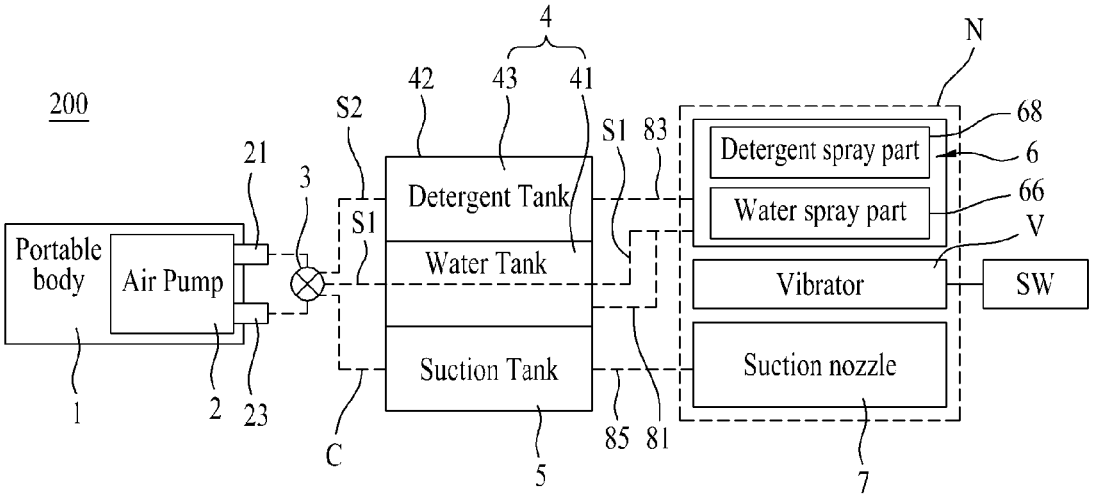

Now, preferred embodiments of the present invention will be described in detail with reference to the annexed drawings. The preferred embodiments described in the specification and shown in the drawings are illustrative only and are not intended to represent all aspects of the invention, and like numbers refer to like elements throughout the description of the figures.

A portable laundry treating apparatus 100 or 200 of the present invention is a machine for removing local contamination from laundry (e.g. clothes), only a portion of which is stained, and has a hand-held structure that is small enough to be used or carried while being held in the hand of an operator.

Particularly, a portable laundry treating apparatus of the present invention has characteristics of supplying at least any one of detergent and water to a contaminated area of laundry and sucking liquid (water, detergent, dirt and the like) from laundry.

FIG. 1*a* is a view illustrating a portable laundry treating apparatus according to an exemplary embodiment of the present invention. A portable laundry treating apparatus 100 according to the embodiment of the present invention comprises a portable body 1 which can be carried by hand, a supply tank 4 in which at least any one of water and detergent is stored, a suction tank 5 which provides a space for storing (or sucking) liquid, and a liquid transferring part which supplies liquid stored in the supply tank 4 to a contaminated area of laundry and sucks liquid remaining in laundry to the suction tank 5.

The supply tank 4, as shown in FIG. 1*a*, may preferably include a water tank 41 in which water is stored and a detergent tank 43 in which liquid detergent is stored. However, the supply tank 4 may include only any one of the water tank 41 and the detergent tank 43. For convenience of explanation, the supply tank 4 including both the water tank 41 and the detergent tank 43 will be explained hereinafter. The supply tank 4 may be fixedly coupled to the portable body 1; however, it is preferable that the supply tank 4 is removably coupled to the portable body 1. In the case of the latter, the supply tank 4 may include a tank body 42 removably coupled to the portable body 1, and a partition wall provided in the tank body 42 in order to separate the water tank 41 and the detergent tank 43 from each other.

Preferably, the portable body 1 may be further provided with a tank support part (not shown) to which the tank body 42 is removably coupled.

The suction tank 5 serves to provide a space for storing liquid. The suction tank 5 may be fixedly coupled to the portable body 1. However, similar to the supply tank 4, it is preferable that the suction tank 5 is removably coupled to the portable body 1 using a tank mounting part (not shown).

The liquid transferring part serves to discharge liquid from the water tank 41 and the detergent tank 43 and also to suck liquid existing outside the suction tank 5 (liquid remaining in laundry) into the suction tank 5. The liquid transferring part may be formed in various types so long as the above-described functions can be achieved.

FIG. 1*a* illustrates an example of the liquid transferring part, which includes an air pump 2 and a plurality of flow channels 8, 81, 83, 85, S and C for connecting the air pump 2 to a nozzle part N and the liquid tanks 4 and 5.

The air pump 2 includes a discharge port 21 through which air is discharged from the air pump 2 and a suction port 23 through which air is sucked into the air pump 2. Such an air pump 2 may be fixedly coupled to the portable body 1. The air pump 2 serves to discharge liquid from the supply tank 4 to laundry and to suck liquid from laundry into the suction tank 5 through the nozzle part N communicating with the respective tanks 41, 43 and 5.

The nozzle part N may include a supply nozzle 6 through which liquid stored in the water tank 41 and the detergent tank 43 is sprayed, and a suction nozzle 7 through which liquid existing outside the suction tank 5 is introduced into the suction tank 5.

The supply nozzle 6 is connected to the discharge port 21 of the air pump 2 through an air supply channel S and is also connected to the water tank 41 and the detergent tank 43 through a discharge channel 8.

The discharge channel 8 may include a water channel 81 for connecting the supply nozzle 6 and the water tank 41, and a detergent channel 83 for connecting the supply nozzle 6 and the detergent tank 43.

Therefore, air discharged from the discharge port 21 of the air pump 2 is discharged to the outside of the portable laundry treating apparatus 100 via the air supply channel S and the supply nozzle 6. If air is discharged from the supply nozzle 6, an internal pressure of the supply nozzle 6 gets lower than an internal pressure of the water tank 41 and the detergent tank 43. Accordingly, liquid in the water tank 41 and the detergent tank 43 flows to the supply nozzle 6 through the discharge channel 8 and is sprayed onto laundry together with air.

The water channel 81 and the detergent channel 83 are preferably connected to a junction part 6391 at which the air supply channel S and the supply nozzle 6 are connected. A cross-sectional area of the junction part 6391 is preferably smaller than a cross-sectional area of channels disposed upstream and downstream of the junction part 6391. In the above structure, liquid stored in the supply tank 4 can be easily discharged to the supply nozzle 6 by a venturi effect.

The discharge channel 8 may be provided with a tank valve 9 to selectively supply water stored in the water tank 41 and detergent stored in the detergent tank 43. In the case in which the water channel 81 and the detergent channel 83 are branched from a single channel connected to the supply nozzle 6 and are respectively connected to the water tank 41 and the detergent tank 43, the tank valve 9 may be disposed at a branching point (or junction point) of the water channel and the detergent channel 83. The tank valve 9 may be configured to supply any one of water and detergent to the supply nozzle 6 or to supply water and detergent to the supply nozzle 6 at the same time.

The suction tank 5 is connected to the suction port 23 of the air pump 2 through an air suction channel C, and is connected to the suction nozzle 7 through a suction channel 85. Therefore, if air in the suction tank 5 moves to the air pump 2 through the suction port 23, an internal pressure of the suction tank 5 decreases, and liquid existing outside the suction nozzle 7 (water, detergent and dirt remaining in laundry) moves to the suction tank 5 through the suction channel 85.

The portable laundry treating apparatus 100 according to the present invention may further include a channel valve 3 for controlling opening/closing of the air supply channel S and the air suction channel C. The channel valve 3 may be configured to open the air supply channel S and the air suction channel C at the same time or to open only any one of the air supply channel S and the air suction channel C. If both the air supply channel S and the air suction channel C are opened, the portable laundry treating apparatus 100 of the present invention operates such that at least any one of water and detergent is supplied to laundry and at the same time liquid remaining in laundry is sucked into the suction tank 5. However, if only the air supply channel S is opened by the channel valve 3, the portable laundry treating apparatus 100 of the present invention operates only to supply at least any one of water and detergent to laundry. If only the air suction channel C is opened by the channel valve 3, the portable laundry treating apparatus 100 of the present invention operates only to suck liquid remaining in laundry into the suction tank 5.

In the case in which only the air supply channel S is opened, external air of the portable body 1 should be supplied to the liquid transferring part though the suction port 23 of the air pump 2. In the case in which only the air suction channel C is opened, air discharged from the discharge port 21 of the air pump 2 should be discharged to the outside of the portable body 1. Therefore, the channel valve 3 may be preferably provided with a channel for supplying external air to the suction port 23 of the air pump 2 when only the air supply channel S is opened and a channel for communicating the discharge port 21 of the air pump 2 with external air when only the air suction channel C is opened.

The portable laundry treating apparatus 100 according to the present invention may further include a vibration part V for vibrating the nozzle part N. The nozzle part N is a component which is supposed to contact laundry. If the nozzle part N is vibrated by the vibration part V, absorption of water or detergent supplied from the supply nozzle 6 to laundry can be promoted, and dirt separated from laundry by detergent or water can be easily sucked by the suction nozzle 7. The vibration part V may be configured to vibrate only any one of the supply nozzle 6 and the suction nozzle 7 or to vibrate both the supply nozzle 6 and the suction nozzle 7. In the case of the latter, the nozzle part N includes a nozzle body to which the supply nozzle and the suction nozzle are fixedly coupled, and the vibration part V is configured to vibrate the nozzle body. In this case, the nozzle body is fixedly coupled to any one of the supply tank 4 and the suction tank 5, and the other one of the supply tank 4 and the suction tank 5 is removably coupled to the nozzle body.

Further, the vibration part V may be configured to be activated when the nozzle body is pressurized by laundry (or contacts laundry). For this, a vibration part switch SW may be provided at a surface of the nozzle part N (or surface of the nozzle body).

FIG. 1*b* is a view illustrating a portable laundry treating apparatus according to another exemplary embodiment of the present invention.

A portable laundry treating apparatus 200 according to this embodiment comprises a portable body 1, liquid storage parts 4 and 5 including a space in which liquid has been stored (space in which liquid to be supplied to laundry has been stored) and a space in which liquid will be stored (space into which liquid will be sucked), and a liquid transferring part to supply liquid stored in the liquid storage part 4 to laundry and to transfer liquid remaining in laundry to the liquid storage part 5.

The liquid storage parts may include a tank body 42 which is removably coupled to the portable body 1, a supply tank 4 which is provided in the tank body 42 and in which at least any one of water and detergent is stored, and a suction tank 5 which is provided in the tank body 42 and into which liquid existing outside the tank body 42 is sucked. In the case in which the supply tank 4 has a structure capable of storing both water and detergent, a plurality of partition walls for separating the water tank 41, the detergent tank 43 and the suction tank 5 from each other are provided in the tank body 42.

The portable laundry treating apparatus 200 according to this embodiment further includes a supply nozzle 6 communicating with the water tank 41 and the detergent tank 43, and a suction nozzle 7 communicating with the suction tank 5. The nozzle part N may be fixedly coupled to the tank body 42. The supply nozzle 6 may include a water spray part 66 communicating with the water tank 41 and a detergent spray part 68 communicating with the detergent tank 43.

In such a case, the liquid transferring part may include an air pump 2 including a discharge port 21 through which air is discharged from the air pump 2 and a suction port 23 through which air is sucked into the air pump 2, and a plurality of channels S1, S2, C, 81, 82 and 83 for connecting the air pump 2 to the liquid storage parts 4 and 5 and the nozzle part N.

In detail, the discharge port 21 of the air pump 2 is connected to the water spray part 66 through a first air supply channel S1 and is connected to the detergent tank 43 through a second air supply channel S2. The suction port 23 of the air pump 2 is connected to the suction tank 5 through an air suction channel C.

The water tank 41 is connected to the water spray part 66 through a water channel 81, the detergent tank 43 is connected to the detergent spray part 68 through a detergent channel 83, and the suction tank 5 is connected to the suction nozzle 7 through a suction channel 85.

Accordingly, if air is supplied to the water spray part 66 through the first air supply channel S1, water stored in the water tank 41 is sprayed onto laundry via the water channel 81 and the water spray part 66. If air is supplied to the detergent tank 43 through the second air supply channel S2, detergent is supplied to laundry via the detergent channel 83 and the detergent spray part 68.

If air in the suction tank 5 moves to the suction port 23 of the air pump 2 through the air suction channel C, liquid remaining in laundry moves to the suction tank 5 via the suction nozzle 7 and the suction channel 85.

The portable laundry treating apparatus 200 according to the present invention may perform all of the above-described processes (the first supply channel, the second supply channel and the air suction channel are all opened) while a user operates the liquid transferring part. Alternatively, the portable laundry treating apparatus 200 may operate to open at least any one of the first air supply channel S1, the second air supply channel S2 and the air suction channel C using the channel valve 3.

The channel valve 3 may be configured to open only any one of the first air supply channel S1, the second air supply channel S2 and the air suction channel C. The channel valve 3 may also be configured to open the air suction channel C and any one of the first air supply channel S1 and the second air supply channel S2. The channel valve 3 may also be configured to open only the first air supply channel S1 and the second air supply channel S2. To achieve this, the channel valve 3 is disposed between the air pump 2 and the channels S1, S2 and C.

The portable laundry treating apparatus 200 according to this embodiment may further include a vibration part V for vibrating the nozzle part N. The vibration part V may be configured to vibrate only any one of the supply nozzle 6 and the suction nozzle 7 or to vibrate both the supply nozzle 6 and the suction nozzle 7. In the case of the latter, the nozzle part N includes a nozzle body which is fixedly coupled to the tank body 42 and supports the supply nozzle and the suction nozzle, and the vibration part V is configured to vibrate the nozzle body. The vibration part V may be configured to be activated when the nozzle body is pressurized by laundry (or contacts laundry). In this case, a switch SW for operating the vibration part V may be provided at a surface of the nozzle body.

FIGS. 2 through 6 are views illustrating an example of the portable laundry treating apparatus 100 depicted in FIG. 1*a*.

As described above, the portable laundry treating apparatus 100 according to this embodiment includes a portable body 1, a supply tank 4 in which at least any one of detergent and water is stored, a suction tank 5 which provides a space capable of storing liquid, a nozzle part N which communicates with the supply tank 4 and the suction tank 5, and a liquid transferring part which is provided at the portable body 1 in order to supply liquid stored in the supply tank 4 to laundry through the nozzle part N and to suck liquid remaining in laundry to the suction tank 5 through the nozzle part N.

The portable body 1 includes a handle 11 which a user can grab to carry the portable laundry treating apparatus 100 of the present invention, and a switch 13 for controlling operation of the liquid transferring part, and more particularly controlling operation of the air pump.

In the case in which the supply tank 4 and the suction tank 5 are removably provided at the portable body 1, the portable body 1 may be further provided with a tank support part 15 to which the supply tank 4 and the suction tank 5 are removably coupled.

The liquid transferring part may include an air pump 2 and channels for connecting the air pump 2 to the nozzle part N and the liquid storage parts 4 and 5.

Figure 3:
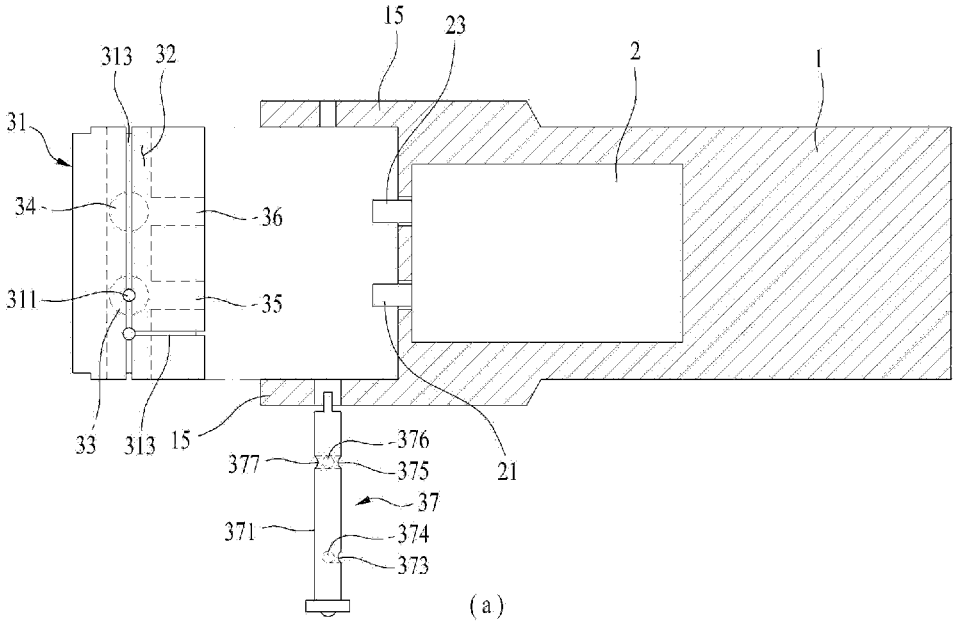
FIGS. 3 and 4 are views illustrating a structure of a channel valve of the portable laundry treating apparatus depicted in FIG. 2.
Figure 3:
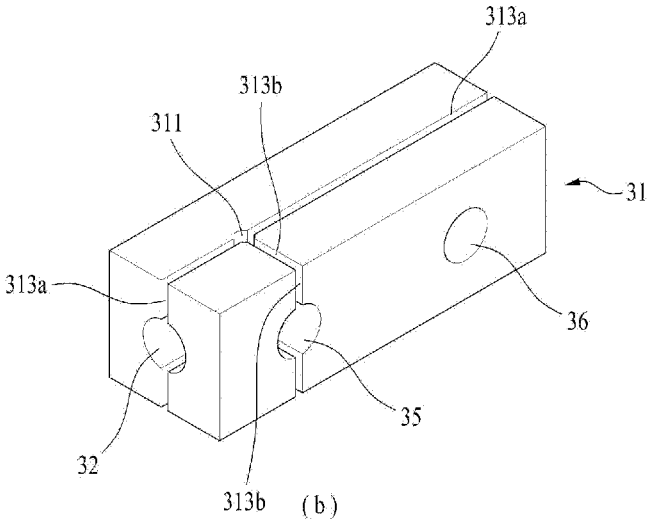

As shown in FIG. 3, the air pump 2 is fixedly provided in the portable body 1, and includes a discharge port 21 through which air is discharged from the air pump 2 and a suction port 23 through which air is sucked into the air pump 2. The discharge port 21 and the suction port 23 of the air pump 2 are exposed to the outside of the portable body 1 through a space defined by a pair of tank support parts 15 which are provided opposite to each other at the portable body 1, and are connected to a channel valve 3.

The channel valve 3 serves to open and close the discharge port 21 and the suction port 23 of the air pump 2 (open and close the air supply channel S and the air suction channel C). The channel valve 3 includes a valve support body 31 fixedly coupled to the portable body 1, a support body through-hole 32 which is formed through the valve support body 31, a discharge port connection pipe 35 for connecting the support body through-hole 32 to the discharge port 21 of the air pump, a suction port connection pipe 36 for connecting the support body through-hole 32 to the suction port 23 of the air pump, a supply channel connection pipe 33 for connecting the support body through-hole 32 to the air supply channel S, a suction channel connection pipe 34 for connecting the support body through-hole 32 to the air suction channel C, and a valve 37 which is rotatably provided in the support body through-hole 32 and controls opening/closing of the connection pipes 35, 36, 33 and 34.

The valve 37 includes a body 371 which penetrates the tank support part 15 and is inserted into the support body through-hole 32, a first body channel 373 which communicates with the discharge port connection pipe 35 and extends toward the inside of the body 371, a second body channel 374 which communicates with the supply channel connection pipe 33 and is connected to the first body channel 373, a third body channel 375 which communicates with the suction port connection pipe 36 and extends toward the inside of the body 371, and a fourth body channel 376 which communicates with the suction channel connection pipe 34 and is connected to the third body channel 375.

As illustrated in FIG. 3, the discharge port connection pipe 35 and the supply channel connection pipe 33 may be arranged at an angle of about 90 degrees with respect to each other. In this case, the first body channel 373 and the second body channel 374 are also arranged at an angle of about 90 degrees with respect to each other.

Since the suction port connection pipe 36 and the suction channel connection pipe 34 are arranged at an angle of about 90 degrees with respect to each other, the third body channel 375 and the fourth body channel 376 are also arranged at an angle of about 90 degrees with respect to each other.

The valve 37 may further include a fifth body channel 377 which is formed in the body 371 and is connected to the first body channel 373 or the third body channel 375. By the fifth body channel 377, only the discharge port connection pipe 35 is connected to the supply channel connection pipe 33, or only the suction port connection pipe 36 is connected to the suction channel connection pipe 34.

As illustrated in FIG. 3, the fifth body channel 377 may be connected to the third body channel 375 and the fourth body channel 376. In this case, the fifth body channel 377 is connected to a junction point of the third body channel 375 and the fourth body channel 376, and thus forms a single straight channel with the third body channel 375.

The valve 37 can connect only the suction port connection pipe 36 to the suction channel connection pipe 34 through the fifth body channel 377, which will be explained in detail later.

In the case in which the fifth body channel 577 is provided to connect only the suction port connection pipe 36 to the suction channel connection pipe 34, air introduced into the support body through-hole 32 from the discharge port 21 of the air pump through the discharge port connection pipe 35 should be discharged to the outside of the valve support body 31.

Therefore, the valve support body 31 preferably further includes a communicating pipe 311 which communicates with the support body through-hole 32, and a communicating groove 313 for discharging air discharged from the support body through-hole 32 through the communicating pipe 311 to the outside of the portable body 1 through a space between the valve support body 31 and the tank support part 15.

In the case in which the discharge port connection pipe 35 and the supply channel connection pipe 33 are arranged at an angle of about 90 degrees with respect to each other, the communicating groove 313 is arranged opposite to the supply channel connection pipe 33 (arranged at an angle of about 180 degrees with respect to the supply channel connection pipe 33).

The communicating groove 313 is concavely formed at a surface of the valve support body 31, and is connected to the communicating pipe 311.

The communicating groove 313 may include a first communicating groove 313*a* which extends from the communicating pipe 311 in parallel with the support body through-hole 32 and is cut in a height direction of the valve support body 31, and a second communicating groove 313*b* which extends from the first communicating groove 313*a* perpendicularly to the support body through-hole 32 and is cut in a height direction of the valve support body 31.

Hereinafter, a channel switching processes of the channel valve 3 will be described with reference to FIG. 4. As shown in FIG. 4*a*, if the first body channel 373 and the second body channel 374 are respectively positioned at the discharge port connection pipe 35 and the supply channel connection pipe 33, the third body channel 375 and the fourth body channel 376 are respectively positioned at the suction port connection pipe 36 and the suction channel connection pipe 34, and the fifth body channel 377 is blocked by an inner peripheral surface of the support body through-hole 32.

Therefore, air discharged from the discharge port of the air pump moves through the discharge port connection pipe 35, the first body channel 373, the second body channel 374 and the supply channel connection pipe 33. External air is sucked into the suction port 23 of the air pump through the suction channel connection pipe 34, the fourth body channel 376, the third body channel 375 and the suction port connection pipe 36.

If the body 37 is rotated (counterclockwise by an angle of about 90 degrees from the state of FIG. 4*a*) as shown in FIG. 4*b*, the second body channel 374 and the fourth body channel 376 are respectively positioned at the discharge port connection pipe 35 and the suction port connection pipe 36.

In this case, the fifth body channel 377 is positioned at the suction channel connection pipe 34. The first body channel 373 communicates with the communicating pipe 311. The third body channel 375 is blocked by an inner peripheral surface of the support body through-hole 32.

Accordingly, external air is sucked into the suction port 23 of the air pump through the suction channel connection pipe 34, the fifth body channel 377, the fourth body channel 376 and the suction port connection pipe 36. Air discharged from the discharge port 21 of the air pump is discharged to the outside of the valve support body 31 through the discharge port connection pipe 35, the second body channel 374, the first body channel 373, the communicating pipe 311 and the communicating groove 313.

Different from the above description, if the channel valve 3 capable of connecting only the discharge port connection pipe 35 to the supply channel connection pipe 33 is embodied, the fifth body channel 377 is connected to a junction point of the first body channel 373 and the second body channel 374, and the communicating pipe 311 is disposed opposite to the suction channel connection pipe 34.

Figure 2:
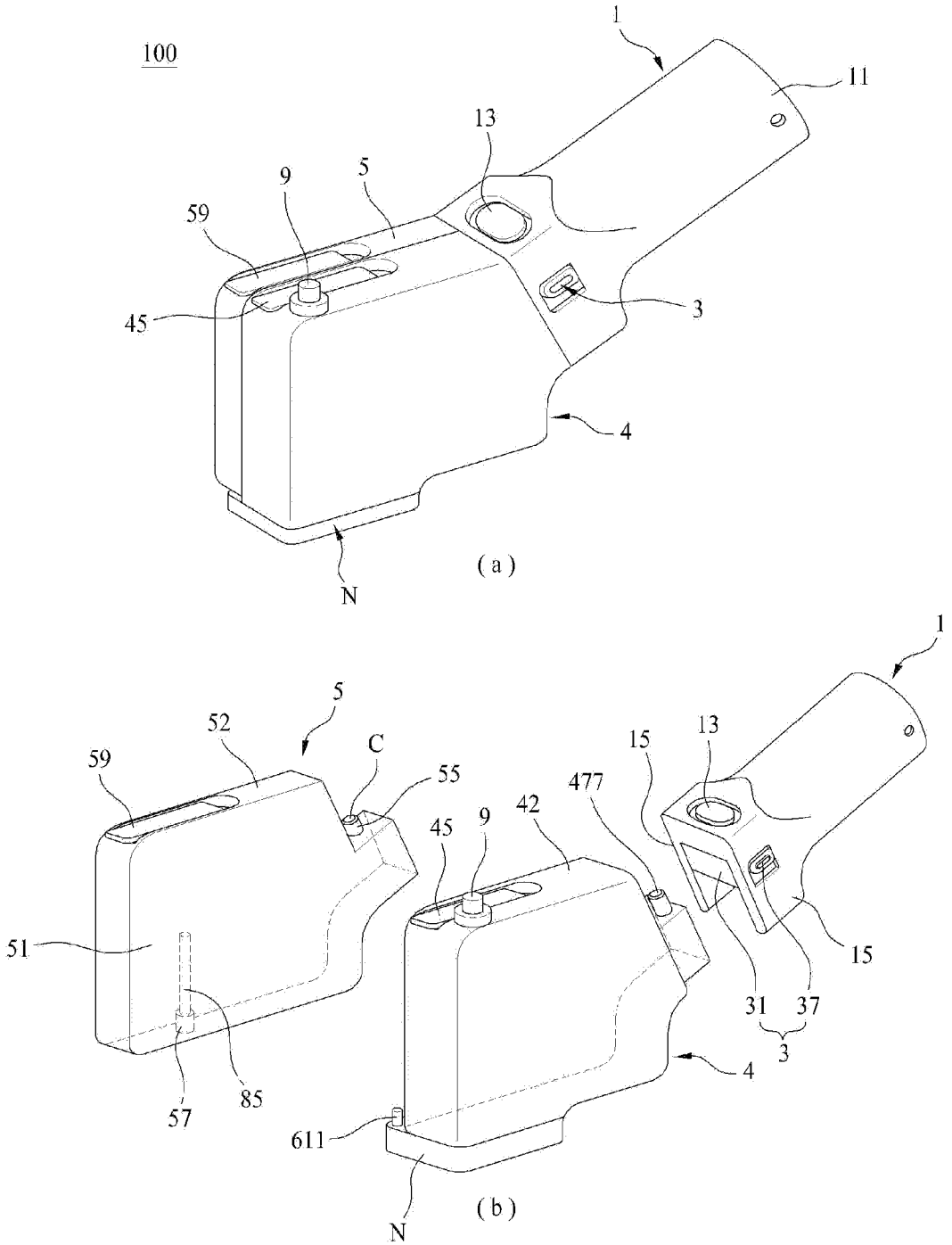
FIG. 2 is a view illustrating an exemplary embodiment of the portable laundry treating apparatus according to the present invention.

As shown in FIG. 2, the suction tank 5 includes a suction tank body 52 which is removably coupled to the tank support part 15, and a suction chamber 51 which is provided in the suction tank body 52 and provides a space for storing liquid. The suction chamber 51 communicates with the outside of the suction chamber 51 through a discharge port formed through the suction tank body 52, and the discharge port is opened and closed by a discharge port opening/closing part 59. Accordingly, a user can remove liquid from the suction chamber 51 through the discharge port opening/closing part 59 and the discharge port.

The suction chamber 51 is connected to the suction port 23 of the air pump 2 through the air suction channel C, and is also connected to a suction hole 613 (refer to FIG. 6) of the nozzle part N through the suction channel 85.

The air suction channel C penetrates a suction tank mounting pipe 55 and communicates with the suction chamber 51. The suction tank mounting pipe 55 protrudes from a surface of the suction tank body 52 so as to be inserted into the suction channel connection pipe 34.

The suction channel 85 protrudes by a certain distance from a bottom surface of the suction chamber 51 in a height direction of the suction chamber 51, which prevents liquid stored in the suction chamber 51 from leaking to the outside of the suction chamber 51 through the suction channel 85.

Accordingly, if air in the suction chamber 51 is sucked into the suction port 23 of the air pump through the air suction channel C, an internal air pressure of the suction chamber 51 is decreased so that liquid remaining in laundry moves to the suction chamber 51 through the suction hole 613 (refer to FIG. 5*b*) and the suction channel 85.

The supply tank 4 includes a supply tank body 42 which is removably coupled to the tank support part 15, a water tank which is provided in the supply tank body 42 to store water, and a detergent tank which is provided in the supply tank body 42 to store detergent. The supply tank body 42 is provided with a supply tank mounting pipe 477 which is inserted into the supply channel connection pipe 33 and communicates with the discharge port 21 of the air pump. The supply tank mounting pipe 477 protrudes from a surface of the supply tank body 42.

Figure 5:
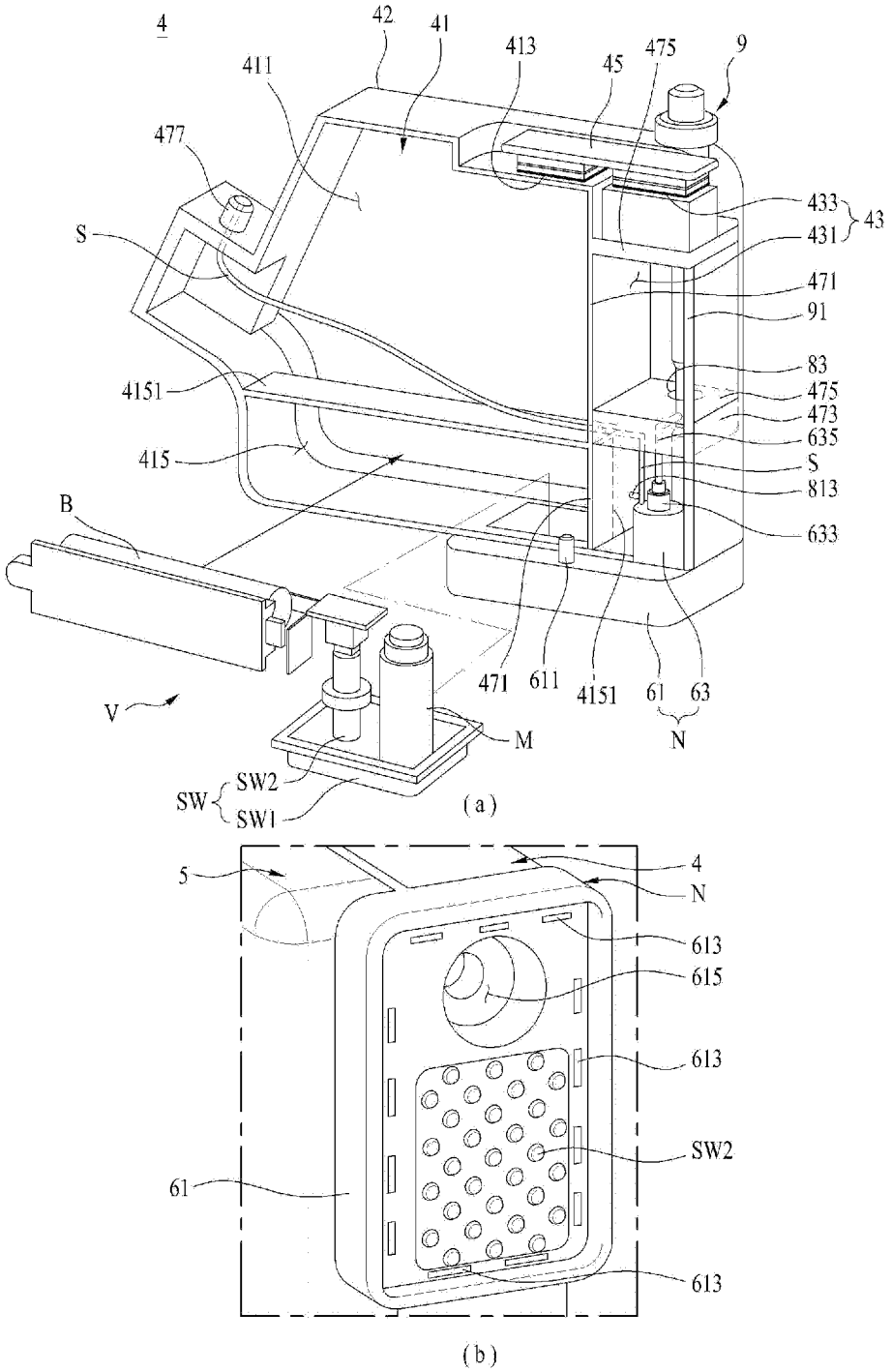
FIG. 5 is a view illustrating a supply tank and a nozzle part of the portable laundry treating apparatus depicted in FIG. 2.

As shown in FIG. 5, the water tank 41 and the detergent tank 43 are separated from each other by a first partition wall 471 which is provided in a height direction of the supply tank body 42.

The water tank 41 is divided into a water chamber 411 in which water is stored and a vibration part accommodation space 415 in which the vibration part V is accommodated. The water chamber (first chamber) 411 and the vibration part accommodation space 415 are separated from each other by an accommodation partition wall 4151 which is fixed to the supply tank body 42.

The water chamber 411 communicates with the outside through a water supply port 413 formed through the supply tank body 42. The water supply port 413 is opened and closed by a supply port opening/closing part 45. Therefore, a user can supply water to the water chamber 411 through the supply port opening/closing part 45.

The detergent tank 43 is provided with a detergent chamber 431 thereinside, in which detergent is stored. The detergent chamber 431 is fixed to the first partition wall 471, and is defined by a second partition wall 473 and a third partition wall 475 which are provided in a longitudinal direction of the supply tank body 42 (perpendicularly to the first partition wall). The third partition wall 475 forming a top surface of the detergent chamber 431 is provided with a detergent supply port 433 which is opened and closed by a supply port opening/closing part 45. Accordingly, a user can supply detergent to the detergent chamber 431 through the supply port opening/closing part 45.

Discharge channels 81 and 83, which supply liquid stored in the water chamber 411 and the detergent chamber 431 to the nozzle part N, are provided under the second partition wall 473 forming a bottom surface of the detergent chamber 431.

Figure 6:
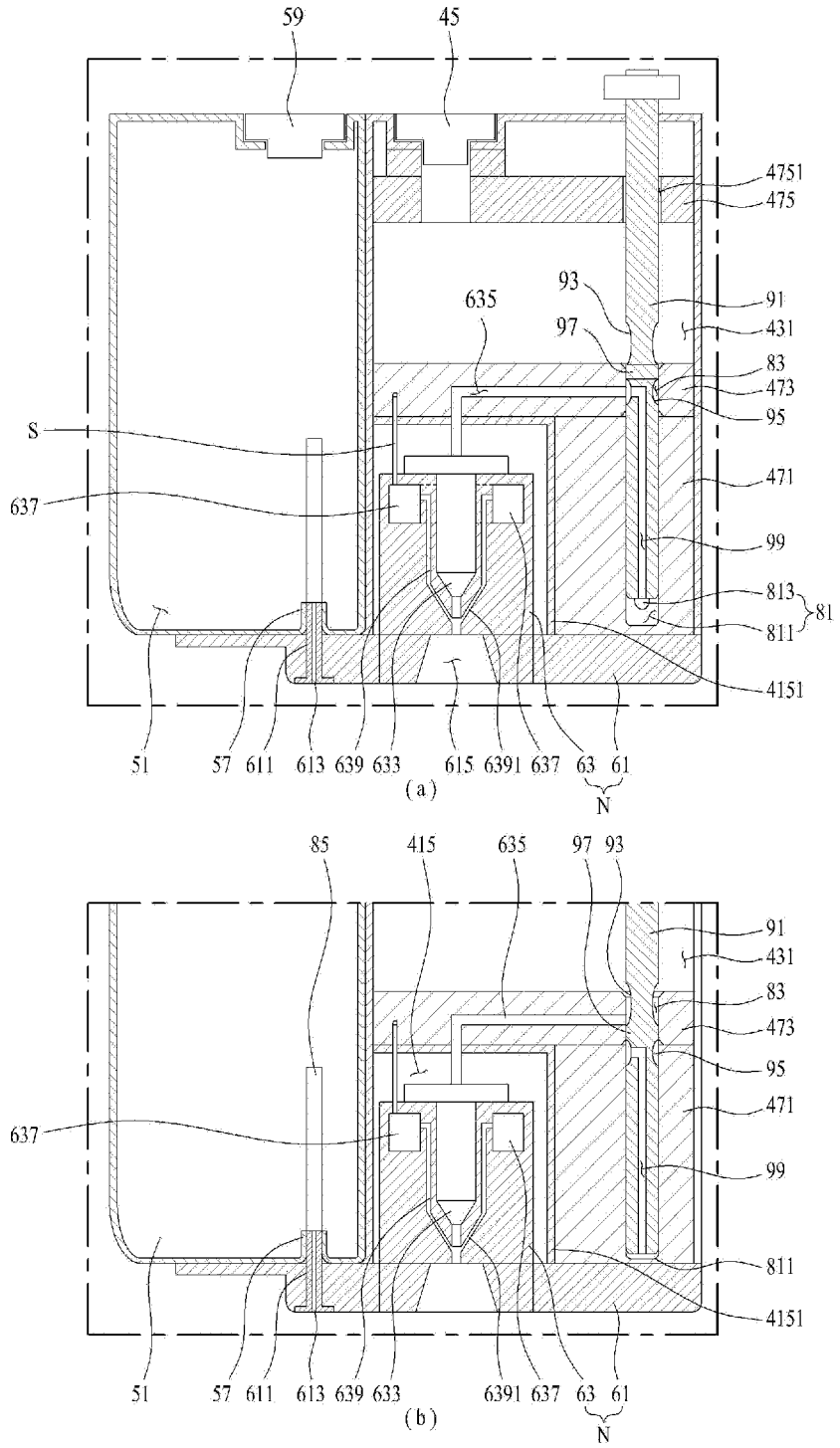
FIG. 6 is a sectional view of a tank valve and a nozzle part of the portable laundry treating apparatus depicted in FIG. 2.

As shown in FIG. 6, the discharge channels 81 and include a water channel 81 for connecting the water chamber 411 to the nozzle part N and a detergent channel for connecting the detergent chamber 431 to the nozzle part N. The detergent channel is configured as a detergent discharge hole 83 which is formed through the second partition wall 473.

The water channel 81 includes a water discharge pipe 813 for discharging water in the water chamber 411 to a space under the second partition wall 473 and a valve accommodation pipe 811 for connecting the water discharge pipe 813 and the detergent discharge hole 83.

The valve accommodation pipe 811 extends from the detergent discharge hole 83 toward the nozzle part N, and the tank valve 9 is positioned in the valve accommodating pipe 811.

The tank valve 9 may include a valve body 91 inserted into the valve accommodation pipe 811 through the detergent discharge hole 83, channel switching parts 93, 95 and 97 provided at an outer peripheral surface of the valve body 91 to allow any one of the detergent channel and the water channel 81 to communicate with a connection channel 635, and a valve channel 99 provided in a longitudinal direction of the valve body 91 to guide water supplied to the valve accommodation pipe 811 to the channel switching parts.

The valve body 91 is inserted into the valve accommodation pipe 811 through a partition wall through-hole 4751 formed at the third partition wall 475 and the detergent discharge hole 83. Preferably, a top surface of the valve body 91 is exposed through the top surface of the supply tank body 42 (surface provided with the supply port opening/closing part 45), which allows a user to change positions of the channel switching parts 93, 95 and 97 by manipulating the valve body 91.

A length of the valve body 91 or the valve accommodation pipe 811 and a position of the water discharge pipe 813 may be set to satisfy the following conditions: if a user moves the valve body 91 toward the bottom surface of the valve accommodation pipe 811, the water discharge pipe 813 is closed by the valve body 91, and if a user moves the valve body 91 away from the bottom surface of the valve accommodation pipe 811, the water discharge pipe 813 is opened.

The channel switching parts include a first recess 93 and a second recess 95 which are concavely formed at a surface of the valve body 91. An opening/closing part 97, which is configured to contact the detergent discharge hole 83, is provided between the first recess 93 and the second recess 95. In this case, if the water discharge pipe 813 is opened by the valve body 91, the opening/closing part 97 is positioned above the connection channel 635. If the water discharge pipe 813 is closed by the valve body 91, the opening/closing part 97 is positioned below the connection channel 635. The valve channel 99 connects a bottom surface of the valve body 91 and the second recess 95.

The nozzle part N is provided at an outer peripheral surface of the supply tank body 42. The nozzle part N includes a nozzle body 61 fixed to the supply tank body 42 and a spray body 63 provided in the nozzle body 61 to discharge detergent or water to the outside of the nozzle body 61.

The nozzle body 61 is provided with a suction hole (suction nozzle) 613 which is connected to the suction channel 85 provided at the suction tank 5. The suction hole 613 is formed through a chamber support pipe 611 which penetrates the nozzle body 61 and is connected to the suction channel 85. In this case, an end portion of the chamber support pipe 611 protrudes from a surface of the nozzle body 61, and a nozzle connection part 57 to which the chamber support pipe 611 is removably coupled is provided at a bottom surface of the suction tank body 52.

The nozzle body 61 is further provided with a discharge part 615 which is formed through the nozzle body 61 and is connected to the spray body 63.

The suction hole 613 may be configured with a single hole which is formed through the nozzle body 61, or may be configured with a plurality of holes which are formed through the nozzle body 61 to be connected to the suction channel 85 and are arranged around an outer peripheral surface of the discharge part 615.

The spray body (supply nozzle) 63 is fixed to the nozzle body 61 and is positioned on the discharge part 615. The spray body 63 may include a storage part 633 connected to the detergent discharge hole 83 through the connection channel 635, a chamber 637 connected to the air supply channel S communicating with the discharge port 21 of the air pump, and a chamber connection pipe 639 for connecting the chamber 637 to the storage part 633 and the discharge part 615.

The chamber 637 serves as a space into which air is introduced through the air supply channel S. The air supply channel S penetrates the first partition wall 471 or the second partition wall 473 so as to connect the chamber 637 and the supply tank mounting pipe 477 (refer to FIG. 5). The chamber 637 may be formed in a ring shape which surrounds an outer peripheral surface of the storage part 633. In this case, the chamber connection pipe 639 may be provided in plural numbers. By virtue of such a structure, even though air is supplied through a portion of the chamber 637 via the air supply channel S, air discharged to the outside of the nozzle body 61 through the discharge part 615 is prevented from flowing in a biased direction.

Preferably, a cross-sectional area of the junction part 6391 is smaller than a cross-sectional area of channels disposed upstream and downstream of the junction part 6391, which allows liquid stored in the storage part 633 to move more easily to the discharge part 615 by a venturi effect.

A water or detergent spraying process of the portable laundry treating apparatus 100 structured as above will now be described. As shown in FIG. 6*a*, if the water discharge pipe 813 is opened by the valve body 91, the opening/closing part 97 is positioned above the connection channel 635. Therefore, connection between the detergent chamber 431 and the nozzle part N is blocked, and the water chamber 411 is connected to the nozzle part N. In other words, water stored in the water chamber 411 can move to the storage part 633 through the water discharge pipe 813, the valve accommodation pipe 811, the valve channel 99 and the connection channel 635.

Air discharged from the discharge port 21 of the air pump 2 moves to the discharge part 615 via the discharge port connection pipe 35, the supply channel connection pipe 33, the supply tank mounting pipe 477, the air supply channel S, the chamber 637, the chamber connection pipe 639 and the junction part 6391. If air is discharged through the discharge part 615, an internal pressure of the discharge part 615 is decreased, and thus water stored in the storage part 633 is sprayed from the discharge part 615 through the junction part 6391. Accordingly, the portable laundry treating apparatus 100 of the present invention can supply water only to a local area of a surface of laundry.

As shown in FIG. 6*b*, if a user presses the valve body 91 toward the bottom surface of the valve accommodation pipe 811, the valve body 91 closes the water discharge pipe 813, and the opening/closing part 97 moves below the connection channel 635. Therefore, connection between the water chamber 411 and the nozzle part N is blocked, and the detergent chamber 431 is connected to the nozzle part N. Detergent stored in the detergent chamber 431 moves to the storage part 633 through the detergent discharge hole 83 and the connection channel 635. Detergent stored in the storage part 633 moves to the discharge part 615 when air is discharged from the discharge part 615, and is sprayed only to a local area of a surface of laundry.

The portable laundry treating apparatus 100 structured as above may further include a vibration part V for vibrating the nozzle part N so that absorption of water or detergent discharged from the discharge part 615 to laundry can be promoted and dirt separated from laundry by detergent or water can be easily sucked by the nozzle part N. One exemplary position of the vibration part V is illustrated in FIG. 5, however, the vibration part V may be disposed at other various positions at which the vibration part V can vibrate the nozzle part N.

The vibration part V is disposed in a vibration part accommodation space 415 provided at the supply tank 4. The vibration part V may include a vibration motor M, a battery B and a switch SW for connecting the vibration motor M to the battery B. The switch SW may include a contact part SW1 which is positioned at a bottom surface of the nozzle body 61 (or may protrude from a bottom surface of the nozzle body), and a motor control part SW2 for supplying power to the vibration motor M by connecting the vibration motor M to the battery B when the contact part SW1 is pressed.

Accordingly, only if a user touches the nozzle body 61 to a surface of laundry will the nozzle part N be vibrated by the vibration part V. As a result, the portable laundry treating apparatus 100 of the present invention can more easily remove local contamination of laundry.

The portable laundry treating apparatus 100 structured as above may be operated in three modes (a suction mode, a detergent supply and suction mode and a water supply and suction mode).

The suction mode is the operational mode of the portable laundry treating apparatus 100 depicted in FIG. 4*b*, the detergent supply and suction mode is the operational mode of the portable laundry treating apparatus 100 depicted in FIGS. 4*a* and 6*b*, and the water supply and suction mode is the operational mode of the portable laundry treating apparatus 100 depicted in FIGS. 4*a* and 6*a*.

Figure 4:
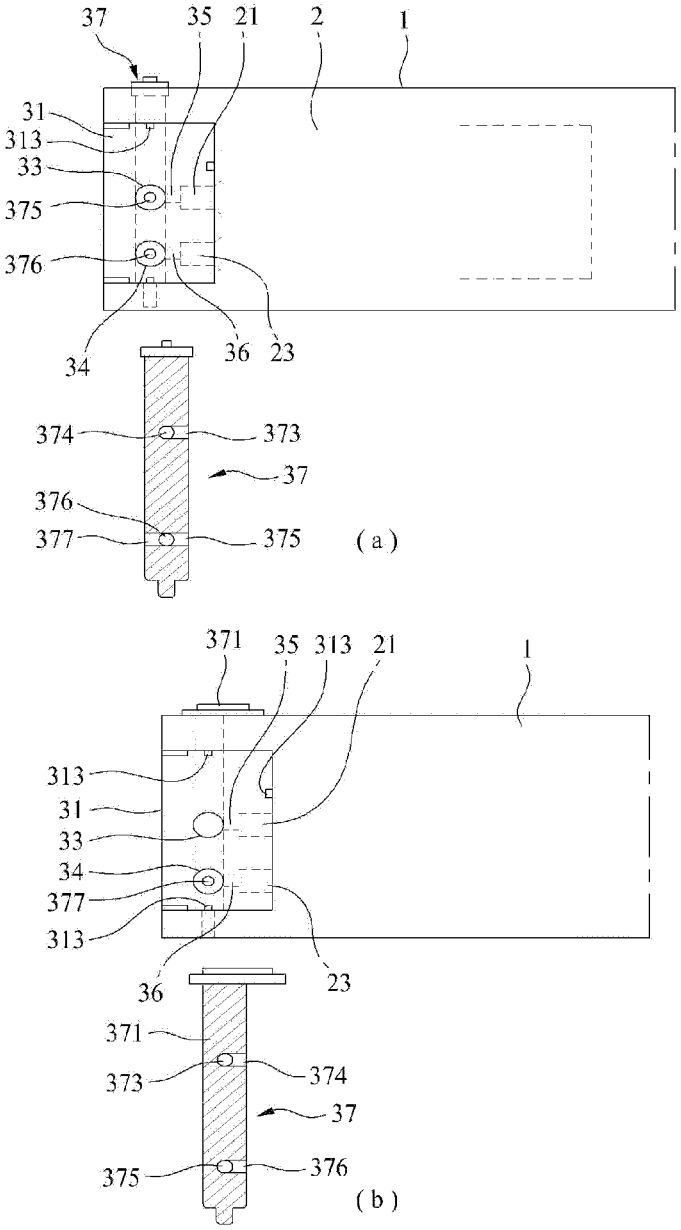

Different from FIG. 4, if the channel valve 3 is provided to connect only the discharge port connection pipe 35 to the supply channel connection pipe 33 (the fifth body channel 377 is connected to a junction part of the first body channel 373 and the second body channel 374, and the communicating pipe 311 is provided opposite to the suction channel connection pipe 34), the portable laundry treating apparatus 100 of the present invention may be operated in four modes (a detergent supply mode, a water supply mode, a detergent supply and suction mode and a water supply and suction mode).

FIGS. 7 through 12 are views illustrating an example of the portable laundry treating apparatus 200 depicted in FIG. 1*b*. The portable laundry treating apparatus 200 according to this embodiment comprises a portable body 1 which can be carried by hand, liquid storage parts 4 and 5 including a water chamber, a detergent chamber and a suction chamber, a nozzle part N communicating with the respective chambers of the liquid storage parts 4 and 5, and a liquid transferring part which supplies liquid stored in the water chamber and the detergent chamber to the nozzle part N and transfers liquid remaining in laundry to the suction chamber through the nozzle part N.

The portable body 1 includes a handle 11 which a user can grab to carry the portable laundry treating apparatus 200 of the present invention, and a switch 13 for controlling operation of the liquid transferring part, more particularly, controlling operation of an air pump provided at the liquid transferring part.

Figure 8:
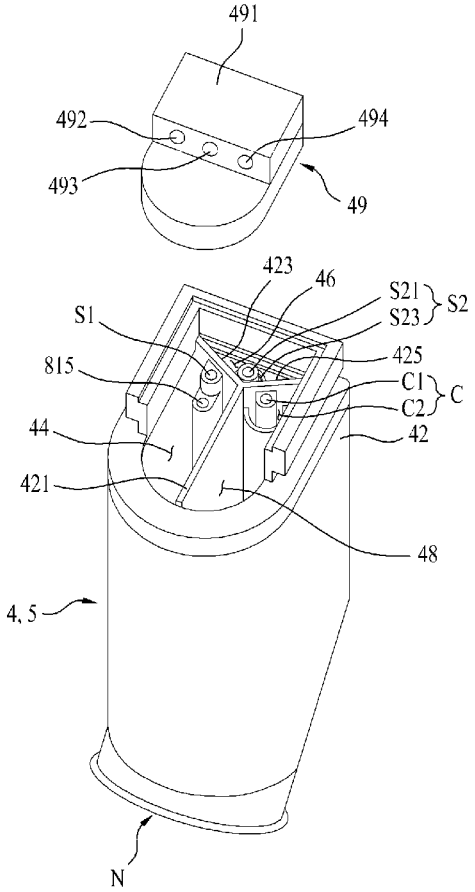
FIG. 8 is a view illustrating a liquid storage part of the portable laundry treating apparatus depicted in FIG. 7.

As shown in FIG. 8, the liquid storage parts 4 and 5 include a tank body 42 for forming an external appearance, a plurality of partition walls 421, 423 and 425 which are provided in the tank body 42 to separate a water chamber 44, a detergent chamber 46 and a suction chamber 48 from each other, and a chamber opening/closing part 49 which is removably coupled to the tank body 42 to open and close the respective chambers 44, 46 and 48.

The first partition wall 421, the second partition wall 423 and the third partition wall 425 divide an internal space of the tank body 42 into three spaces. The first partition wall 421 may extend from a bottom surface of the tank body 42 in a height direction of the tank body 42, and the second partition wall 423 and the third partition wall 425 may extend from the first partition wall 421 to upper corners of the tank body 42, such that the three partition walls may be arranged in a Y shape in the tank body.

In this case, the water chamber 44 is defined by the first partition wall 421, the second partition wall 423 and an inner peripheral surface of the tank body 42. The detergent chamber 46 is defined by the second partition wall 423, the third partition wall 425 and an inner peripheral surface of the tank body 42. The suction chamber 48 is defined by the third partition wall 425, the first partition wall 421 and an inner peripheral surface of the tank body 42.

The three chambers 44, 46 and 48 may have the same volume. However, since the use of detergent is generally less than the use of water, the detergent chamber 46 may be formed to have a smaller volume than the water chamber 44 or the suction chamber 48.

A first air supply channel S1 connected to the nozzle part N is provided in the water chamber 44. A second air supply channel S2 for supplying air into the detergent chamber 46 is provided in the detergent chamber 46. An air suction channel C for discharging air from the suction chamber 48 is provided in the suction chamber 48.

The chamber opening/closing part 49 enables a user to supply water or detergent to the water chamber 44 or the detergent chamber 46 and also to discharge liquid from the suction chamber 48. The chamber opening/closing part 49 includes an opening/closing body 491, and a partition wall accommodation recess 498 which is formed at a surface of the opening/closing body 491 to accommodate the partition walls 421, 423 and 425 therein.

Figure 7:
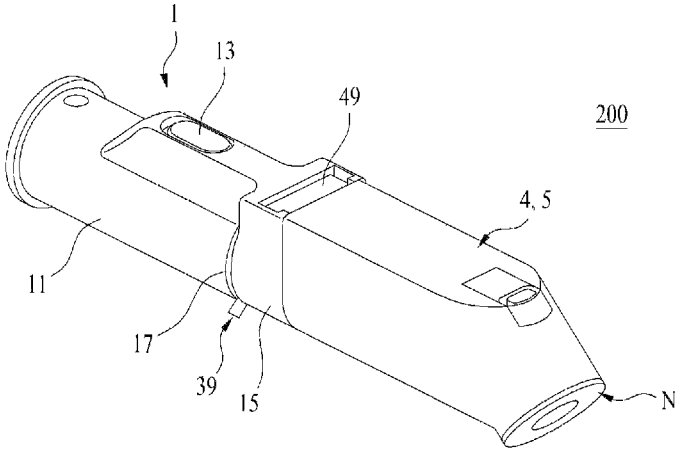
FIG. 7 is a view illustrating another exemplary embodiment of the portable laundry treating apparatus according to the present invention.
Figure 7:
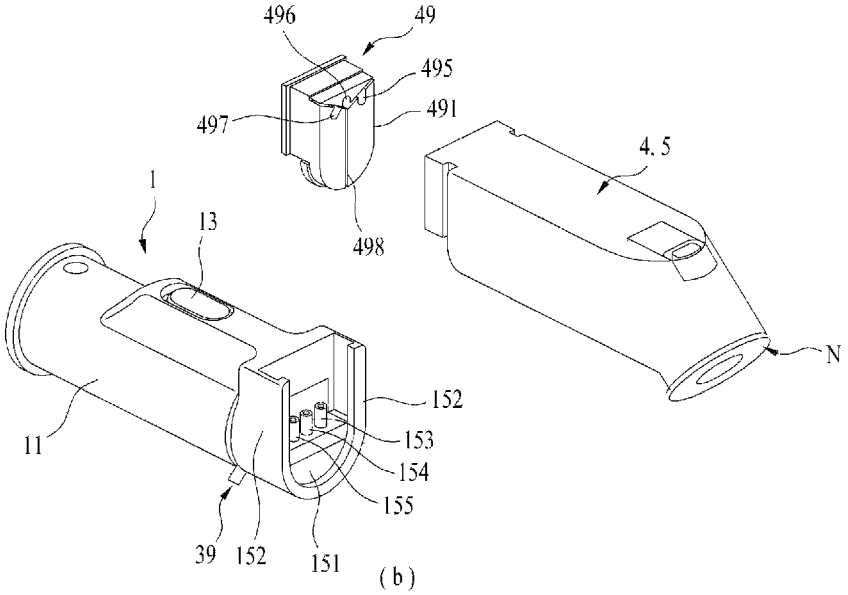

As shown in FIG. 7, a front surface of the opening/closing body 491 (a surface of the opening/closing body 491, at which the partition wall accommodation recess 498 is formed) is formed with a first channel insertion hole 495 into which the first air supply channel S1 is inserted, a second channel insertion hole 496 into which the second air supply channel S2 is inserted and a third channel insertion hole 497 into which the air suction channel C is inserted.

As shown in FIG. 8, a rear surface of the opening/closing body 491 (a surface of the opening/closing body 491, at which the partition wall accommodation recess 498 is not formed) is formed with a first pipe accommodation hole 492 communicating with the first channel insertion hole 495, a second pipe accommodation hole 493 communicating with the second channel insertion hole 496, and a third pipe accommodation hole 494 communicating with the third channel insertion hole 497.

Preferably, the tank body 42 structured as above is removably coupled to the portable body 1. For this, the portable body 1 may be further provided with a tank support part 15 in which an outer peripheral surface of the tank body 42 is removably accommodated.

Figure 9:
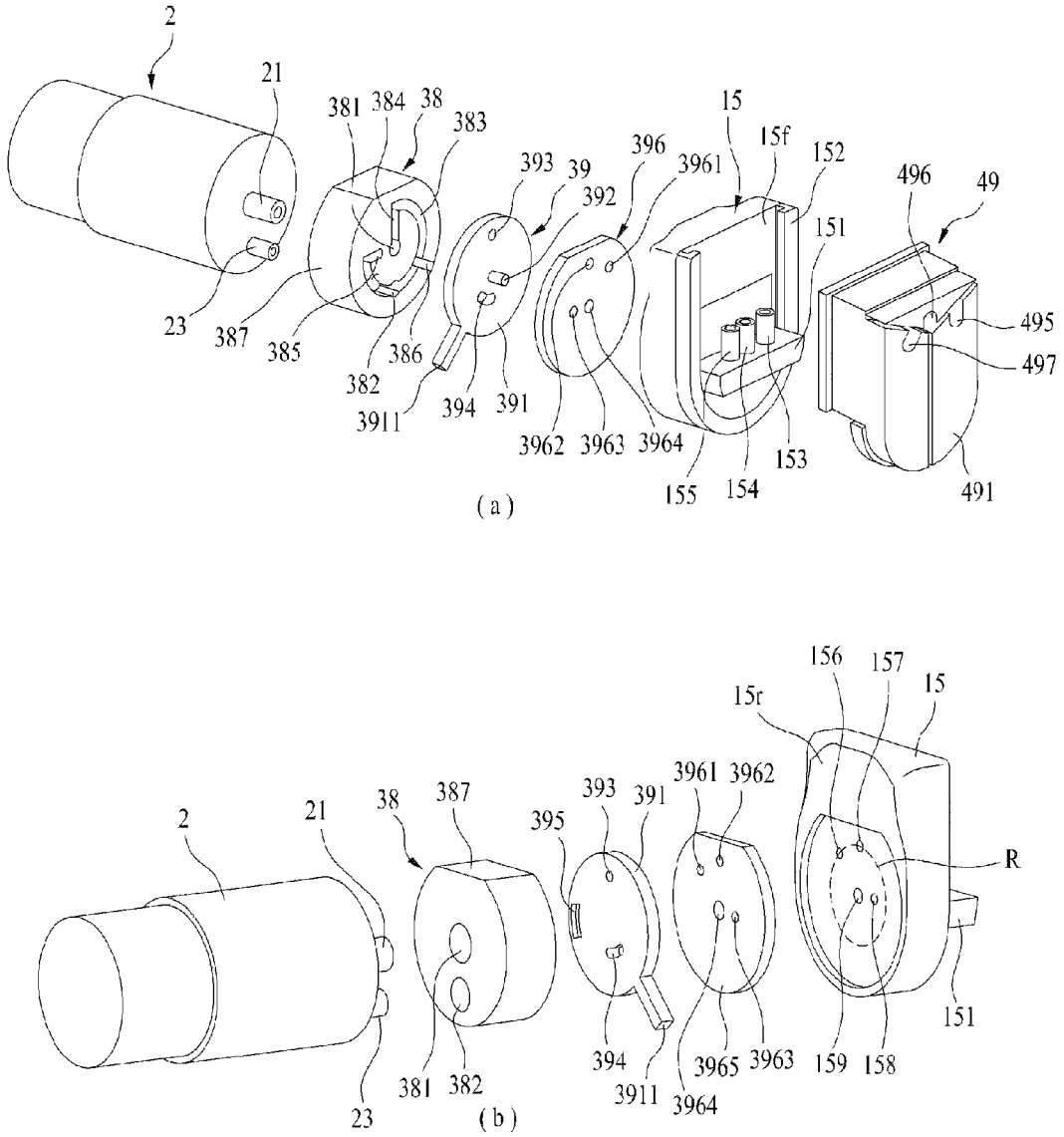
FIGS. 9 and 10 are views illustrating a channel valve of the portable laundry treating apparatus depicted in FIG. 7.

As shown in FIG. 9, the tank support part 15 may include a flange 152 which is provided at the portable body 1 and in which the outer peripheral surface of the tank body 42 is fitted, and a support body 151 for supporting the tank body 42 coupled to the flange 152.

The support body 151 is provided with a first pipe 153 inserted into the first pipe accommodation hole 492 of the chamber opening/closing part 49, a second pipe 154 inserted into the second pipe accommodation hole 493, and a third pipe 155 inserted into the third pipe accommodation hole 494.

The first pipe 153, the second pipe 154 and the third pipe 155 are provided at a front surface 15*f* of the tank support part 15 and are exposed to the outside of the portable body 1. A rear surface 15*r* of the tank support part 15 is formed with a first hole 156 connected to the first pipe 153, a second hole 157 connected to the second pipe 154, and a third hole 158 connected to the third pipe 155.

When viewed from the rear of the tank support part 15, the first hole 156, the second hole 157 and the third hole 158 are sequentially arranged clockwise on the rear surface 15*r* of the tank support part 15. However, when viewed from the front of the tank support part 15, the third hole 158, the second hole 157 and the first hole 156 are sequentially arranged clockwise on the rear surface 15*r* of the tank support part 15.

The rear surface 15*r* of the tank support part 15 is further provided with a rotating shaft accommodation recess 159 in which a rotating shaft 392 of the channel valve (which will be described later) is accommodated.

In this case, the first hole 156 and the second hole 157 are arranged apart from each other by a certain interval therebetween along a circumference R of a circle, the center of which is the rotating shaft accommodation recess 159 (positioned at the same distance from the rotating shaft accommodation recess 159 and arranged apart from each other by a certain interval), and the third hole 158 is not positioned on the circumference R of the circle, on which the first hole 156 and the second hole 157 are positioned. For example, the third hole 158 is positioned on a circumference of another circle which has a different diameter from the circle on the circumference R of which the first hole 156 and the second hole 157 are positioned.

FIG. 9 illustrates one example in which the third hole 158 is positioned at an inner area of the circumference R of the circle. Alternatively, the third hole 158 may be positioned at an outer area of the circumference R of the circle. For convenience of explanation, this embodiment will now be described based on arrangement of the first hole, the second hole and the third hole depicted in FIG. 9.

The liquid transferring part may include an air pump 2, a first air supply channel S1 for connecting the air pump 2 to the nozzle part N, a second air supply channel S2 and an air suction channel C for respectively connecting the air pump 2 to the detergent chamber and the suction chamber, and channels 81, 83 and 85 (refer to FIGS. 10 through 12) by which the respective chambers of the liquid storage part communicate with the nozzle part N.

The air pump 2 is fixedly provided in the portable body 1, and includes a discharge port 21 through which air is discharged from the air pump 2 and a suction port 23 through which air is sucked into the air pump 2.

A channel valve 3 for controlling opening/closing of the first hole 156, the second hole 157 and the third hole 158 is provided between the air pump 2 and the rear surface 15*r* of the tank support part 15. The channel valve 3 may include a pump connection part 38 to which the discharge port 21 and the suction port 23 of the air pump 2 are coupled, and a valve 39 which is rotatably provided between the pump connection part 38 and the tank support part 15.

The valve 39 includes a valve body 391 rotatably provided in the portable body 1, a rotating shaft 392 provided at the valve body 391 and inserted into the rotating shaft accommodation recess 159, a through-hole 393 and a slot 394 formed through the valve body 391, and an external air channel opening/closing part 395 provided at the valve body 391 and extending toward the pump connection part 38.

The valve body 391 is provided with a valve handle 3911 which is exposed to the outside of the portable body 1. The valve handle 3911 is positioned in a valve accommodation slot 17 (refer to FIG. 7) which is formed along an outer peripheral surface of the portable body 1.

The through-hole 393 serves to open and close any one of the first hole 156 and the second hole 157 according to a rotation angle of the valve body 391. Accordingly, the first hole 156 and the second hole 157 are formed at the rear surface 15*r* of the tank support part 15 and are disposed on the circumference R of the circle, the radius of which is a distance between the rotating shaft 392 and the through-hole 393.

The slot 394 serves to open and close the third hole 158 according to a rotation angle of the valve body 391. The slot 394 may be formed in an arc shape. In detail, the slot 394 may have an arc shape which extends from a point apart from the through-hole 393 by about 180 degrees toward the through-hole 393 in a rotating direction of the valve body 391. In this case, the slot 394 of an arc shape may have a length and a position capable of opening the third hole 158 both when the first hole 156 is opened (water is sprayed) and when both the first hole 156 and the second hole 157 are closed (water and detergent are not sprayed).

The external air channel opening/closing part 395 is configured to close an external air channel only when the first hole 156 and the third hole 158 are opened at the same time by the through-hole 393 and the slot 394.

The pump connection part 38 is configured to supply air from the air pump 2 to the valve 39 and transfer air introduced into the valve 39 through the third hole 158 to the suction port 23 of the air pump 2.

The pump connection part 38 includes a connection body 387 which is coupled to the air pump 2, a discharge port accommodation hole 381 which is formed through the connection body 387 and into which the discharge port 21 of the air pump is inserted, and a suction port accommodation hole 382 which is formed through the connection body 387 and into which the suction port 23 of the air pump 2 is inserted.

The discharge port 21 of the air pump 2 may be located at the same position as a rotation center (rotating shaft 392) of the valve 39.

A surface of the connection body 387 (front surface of the connection body) contacting the valve 39 may be provided with a first connection channel 384 which extends from the discharge port accommodation hole 381 to a point corresponding to the second hole 157, a second connection channel 385 which extends from a point corresponding to the third hole 158 in a direction away from the discharge port accommodation hole 381, a main channel 383 which connects the first connection channel 384 and the second connection channel 385 and at which the suction port accommodation hole 382 is positioned, and an external air channel 386 by which the main channel 383 communicates with the outside of the portable body 1 and which is opened and closed by the external air channel opening/closing past 395.

The main channel 383 may be formed in an arc shape that has the same radius of curvature as the radius of the circumference R of the circle on which the first hole 156 and the second hole 157 are positioned. In this case, the first connection channel 384 has the same length as the radius of the circumference R of the circle on which the first hole 156 and the second hole 157 are positioned, and the second connection channel 385 has a smaller length than the radius of the circumference R of the circle.

The first connection channel 384 and the second connection channel 385 are arranged perpendicularly to each other, and the suction port accommodation hole 382 is disposed at a point at which an extension line of the first connection channel 384 intersects with the main channel 383.

The external air channel 386, by which the main channel 383 communicates with the outside of the portable body 1, is positioned between the suction port accommodation hole 382 and a point corresponding to the first hole 156. An outer peripheral surface of the portable body 1 is formed with an external air channel communicating hole (not shown) through which the external air channel 386 communicates with the outside of the portable body 1.

Since the main channel 383, the first connection channel 384, the second connection channel 385 and the external air channel 386 should be sealed by the surface of the valve body 391, the channels 383, 384, 385 and 386 are concavely formed at the surface of the connection body 387.

The channel valve 3 may further include a sealing part 396 for sealing a gap between the valve body 391 and the rear surface 15*r* of the tank support part 15. The sealing part 396 has a similar structure to the rear surface 15*r* of the tank support part 15. In detail, the sealing part 396 includes a sealing body 3965, a first sealing hole 3961 communicating with the first hole 156, a second sealing hole 3962 communicating with the second hole 157, a third sealing hole 3963 communicating with the third hole 158, and a rotating shaft through-hole 3964 communicating with the rotating shaft accommodation hole 159. The first, second and third sealing holes 3961, 3962 and 3963 and the rotating shaft through-hole 3964 are formed through the sealing body 3965.

Figure 10:
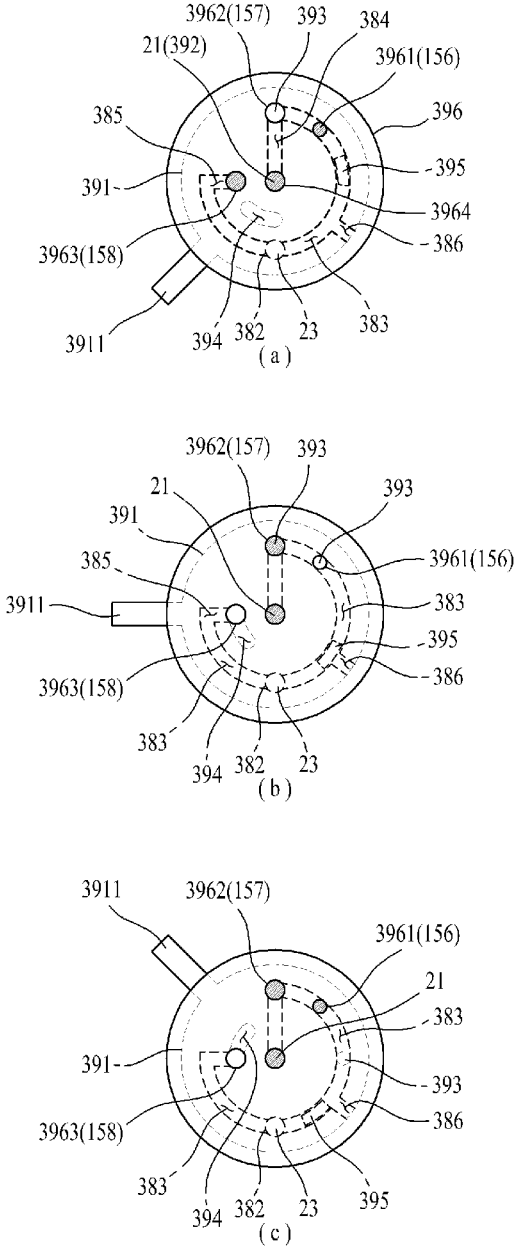

Hereinafter, operation of the above-described channel valve 3 will be described with reference to FIG. 10. An initial position of the valve 39 may be diversely set. For example, an initial position of the valve 39 may be set to a position in which the through-hole 393 and the slot 394 do not open any one of the sealing holes 3961, 3962 and 3963, or may be set to any one of positions depicted in FIGS. 10*a* through 10*c*. Hereinafter, description will be made based on the case in which the initial position of the valve 39 is set as illustrated in FIG. 10*a* for convenience of explanation.

When the valve 39 is located at the initial position, the valve 39 opens the second sealing hole 3962 and the second hole 157 formed at the tank support part 15.

In such a state, if power is applied to the air pump 2 through the switch 13, air discharged from the discharge port 21 of the air pump 2 is introduced into the main channel 383 through the discharge port accommodation hole 381 and the first connection channel 384. Because air introduced into the main channel 383 cannot move to the external air channel 386 by the external air channel opening/closing part 395, air introduced into the main channel 383 is discharged to the second sealing hole 3962 and the second hole 157.

The second hole 157 is connected to the second pipe 154 provided at the front surface 15*f* of the tank support part 15, and the second pipe 154 is connected to the second air supply channel S2 through the second pipe accommodation hole 493 and the second channel insertion hole 496 of the chamber opening/closing part 49. Therefore, air discharged from the discharge port 21 of the air pump 2 is supplied into the detergent chamber 46 through the second air supply channel S2 and increases an internal pressure of the detergent chamber 46.

If power is applied to the air pump 2, external air of the portable body 1 moves to the suction port 23 of the air pump 2 through the external air channel 386, the main channel 383 and the suction port accommodation hole 382.

If a user rotates the valve handle 3911 clockwise by a certain angle as shown in FIG. 10*b*, the through-hole 393 moves toward the first sealing hole 3961, the slot 394 moves toward the third sealing hole 3963, and the external air channel opening/closing part 395 moves toward the external air channel 386. Accordingly, the first sealing hole 3961 and the third sealing hole 3963 are opened, and the external air channel 386 is closed.

In this case, air discharged from the discharge port 21 of the air pump 2 is supplied to the discharge port accommodation hole 381, the first connection channel 384 and the main channel 383. Air supplied to the main channel 393 is supplied to the first sealing hole 3961 through the through-hole 393.

The first sealing hole 3961 is connected to the first hole 156 formed at the rear surface 15*r* of the tank support part 15. The first hole 156 is connected to the first air supply channel S1 through the first pipe 153, the first pipe accommodation hole 492 and the first channel insertion hole 495. Accordingly, air discharged from the discharge port 21 of the air pump 2 moves to the nozzle part N through the first air supply channel S1.

The slot 394 allows the third sealing hole 3963 to communicate with the second connection channel 385. The third sealing hole 3963 is connected to the suction chamber 48 through the third hole 158, the third pipe 155, the third pipe accommodation hole 494, the third channel insertion hole 497 and the air suction channel C.

Accordingly, if power is applied to the air pump 2, air in the suction chamber 48 moves to the suction port 23 of the air pump 2 through the air suction channel C, the third channel insertion hole 497, the third pipe accommodation hole 494, the third pipe 155, the third hole 158, the third sealing hole 3963, the slot 394, the second connection channel 385, the main channel 383 and the suction port accommodation hole 382.

If a user further rotates the valve handle 3911 clockwise by a certain angle from the state of FIG. 10*b*, the valve 39 becomes a state of FIG. 10*c*. In this case, the through-hole 393 is positioned at a point corresponding to the first sealing hole 3961 and the external air channel 386, the slot 394 moves toward the second sealing hole 3962, and the external air channel opening/closing part 395 moves toward the suction port accommodation hole 382.

Therefore, the second sealing hole 3962 and the first sealing hole 3961 are closed by the valve body 391, and the external air channel 386 is opened. Since the slot 394 has an arc shape which is long enough to open the third sealing hole 3963 even when both the second sealing hole 3962 and the first sealing hole 3961 are closed, the third sealing hole 3963 is kept opened by the slot 394. In this case, air discharged from the discharge port 21 of the air pump 2 is discharged to the outside of the portable body 1 through the first connection channel 384, the main channel 383 and the external air channel 386.

Air in the suction chamber 48 is sucked into the suction port 23 of the air pump 2. Since such a suction process is the same as described above with reference to FIG. 10*b*, detailed explanation thereof will be omitted.

Hereinafter, a process of spraying water or detergent stored in the water chamber 44 and the detergent chamber 46 through the nozzle part N and a process of transferring liquid remaining in laundry to the suction chamber 48 will be described.

Figure 11:
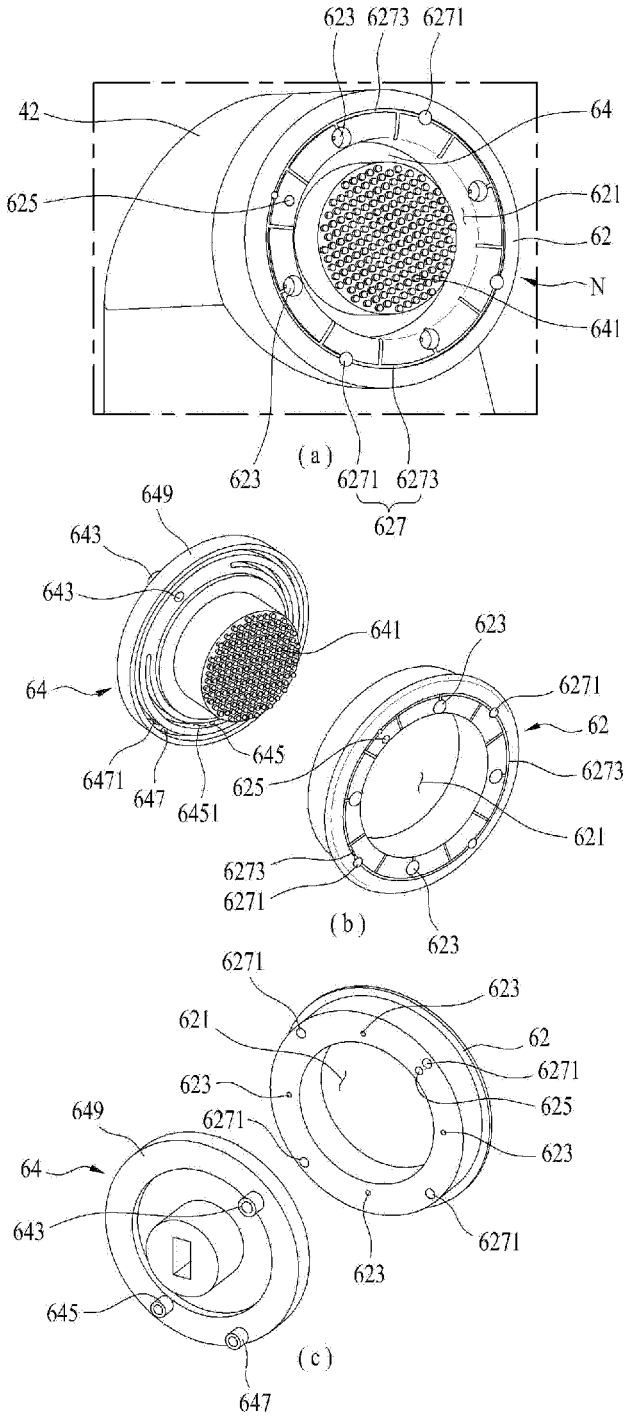
FIG. 11 is a view illustrating a nozzle part of the portable laundry treating apparatus depicted in FIG. 7.
Figure 12:
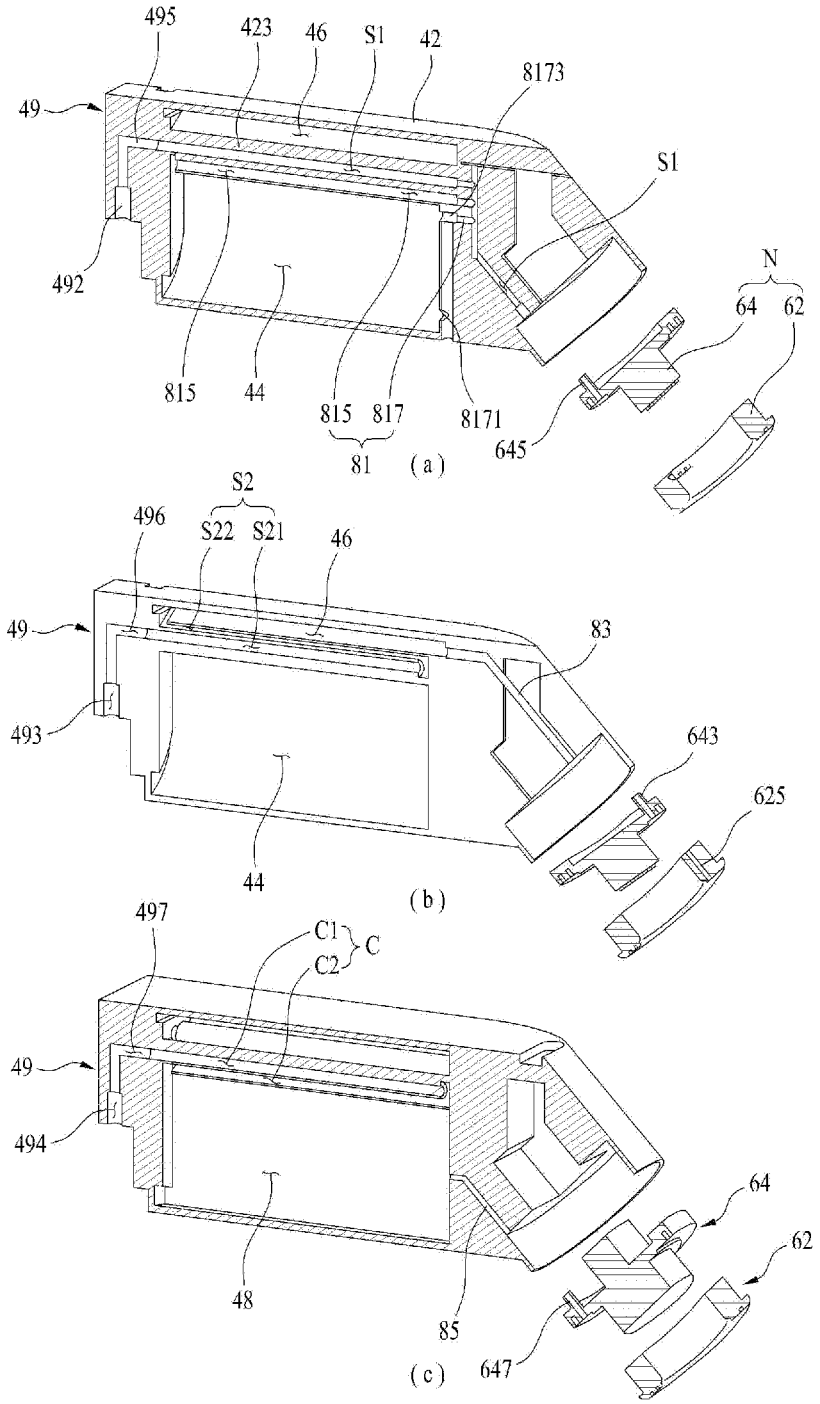
FIG. 12 is a view illustrating an air supply channel, an air suction channel, a water channel, a detergent channel and a suction channel of the portable laundry treating apparatus depicted in FIG. 7.

FIG. 11 is a view illustrating the nozzle part N of the portable laundry treating apparatus according to this embodiment of the present invention. The nozzle part N may include a second nozzle body 64 which is fixed to the tank body 42 to communicate with the respective chambers 44, 46 and 48, and a first nozzle body 62 which is fixed to the second nozzle body 64 and has a contact surface configured to contact laundry.

The first nozzle body 62 is provided with a water discharge hole 623, a detergent discharge hole 625 and a suction part 627. The water discharge hole 623 and the detergent discharge hole 625 are formed through the first nozzle body 62. Liquid discharged from the water chamber 44 and the detergent chamber 46 through the second nozzle body 64 is supplied to laundry through the water discharge hole 623 and the detergent discharge hole 625.

The suction part 627 may include at least two suction holes 6271 which are formed through the first nozzle body 62 and a hole connection recess 6273 for connecting the suction holes 6271 to each other. The connection recess 6273 may be concavely formed at a surface of the first nozzle body 62 which is configured to contact laundry.

The water discharge hole 623 and the detergent discharge hole 625 may be provided in plural numbers at the first nozzle body 62. FIG. 11 illustrates an exemplary structure including four water discharge holes 623 and one detergent discharge hole 625. The water discharge hole 623 may communicate with the connection recess 6273. By this structure, when liquid moves to the suction chamber 48 through the suction part 627, the water discharge hole 623 can also perform the function of the connection recess 6273 (which will be described in detail later).

The second nozzle body 64 includes a fixing part 649 provided at the tank body 42 to support the first nozzle body 62, a water discharge pipe 645 extending from the fixing part 649 toward the water chamber 44, a detergent discharge pipe 643 extending from the fixing part 649 toward the detergent chamber 46, and a suction pipe 647 extending from the fixing part 649 toward the suction chamber 48.

The water discharge pipe 645 is formed through the fixing part 649 and is connected to the water discharge hole 623. In the case in which the water discharge hole 623 is provided in plural numbers, it is preferable that the water discharge pipe 645 communicates with a discharge hole connection channel 6451 which connects the plural water discharge holes 623 to each other. In this case, the discharge hole connection channel 6451 is provided at a surface of the second nozzle body 64 which contacts the first nozzle body 62, and the water discharge pipe 645 penetrates the fixing part 649 and is connected to the discharge hole connection channel 6451.

The detergent discharge pipe 643 is formed through the fixing part 649 and is connected to the detergent discharge hole 625. In the case in which the detergent discharge hole 625 is provided in plural numbers, the detergent discharge pipe 643 may have the same structure as the water discharge pipe 645.

The suction pipe 647 is also formed through the fixing part 649 and is connected to the suction part 627. In the case in which the suction part is configured with plural suction holes 6271, it is preferable that the suction pipe 647 communicates with a suction hole connection channel 6471 by which the respective suction holes 6271 communicate with each other. The suction hole connection channel 6471 is concavely formed at a surface of the second nozzle body 64 which contacts the first nozzle body 62, and the suction pipe 647 penetrates the fixing part 649 and is connected to the suction hole connection channel 6471.

The first nozzle body 62 may be configured to be vibrated by the vibration part (not shown). In this case, the vibration part is fixedly provided in the tank body 42, and the first nozzle body 62 is fixed to the vibration part. The vibration part serves to vibrate the second nozzle body through the first nozzle body 62, thereby enhancing washing performance. The vibration part may be configured to vibrate the nozzle part N when the portable laundry treating apparatus 200 contacts laundry. In other words, the nozzle part N may function as a switch of the vibration part.

The second nozzle body 64 has a body through-hole 621 which is formed through the second nozzle body 64, and the first nozzle body 62 is further provided with a protruding part 641 which is inserted into the body through-hole 621 and protrudes to the outside of the first nozzle body 62. In this case, the protruding part 641 protrudes from the fixing part 649, and the vibration part may be configured to operate when external force is applied to the protruding part 641.

As shown in FIG. 12*a*, the water discharge pipe 645 provided at the nozzle part N is connected to the first channel insertion hole 495 of the chamber opening/closing part 49 through the first air supply channel S1, and the water chamber 44 is connected to the first air supply channel S1 through the water channel 81.

The water channel 81 includes a first water discharge channel 815 which is provided in a longitudinal direction of the water chamber 44 and by which the first air supply channel S1 and the water chamber 44 communicate with each other, and a second water discharge channel 817 which is provided in a height direction of the water chamber 44 to allow the water chamber 44 to communicate with the first air supply channel S1.

The first water discharge channel 815 is configured with a pipe which extends from a connection point with the first air supply channel S1 toward the inside of the water chamber 44, and the second water discharge channel 817 communicates with the first air supply channel S1 through a first discharge hole 8171 and a second discharge hole 8173 which are formed through the water chamber 44.

In this case, the first discharge hole 8171 is positioned at a lower portion (e.g., lowermost end portion) of the water chamber 44, the second discharge hole 8173 is positioned above the first discharge hole 8171, and the first water discharge channel 815 is positioned above the second discharge hole 8173 (e.g., uppermost end portion of the water chamber). The water channel 81 structured as above allows water in the water chamber 44 to be discharged therefrom regardless of a degree of inclination of the portable laundry treating apparatus 200.

The nozzle part N may be inclined downward or upward according to the use of the portable laundry treating apparatus 200. When the portable laundry treating apparatus 200 is in a horizontal state or the nozzle part N is inclined downward, the second water discharge channel 817 allows the water chamber 44 to communicate with the first air supply channel S1. When the nozzle part N is inclined upward, the first water discharge channel 815 allows the water chamber 44 to communicate with the first air supply channel S1.

Accordingly, if air is supplied to the first air supply channel S1 through the channel valve 3 (refer to FIG. 10*b*), an internal pressure of the first air supply channel S1 is decreased and thus, water in the water chamber 44 moves to the first air supply channel S1 through the water channel 81. Water in the first air supply channel S1 moves to the discharge hole connection channel 6451 through the water discharge pipe 645, and water in the discharge hole connection channel 6451 is sprayed onto a contaminated area of laundry through the water discharge hole 623.

As shown in FIG. 12*b*, the detergent discharge pipe 643 provided at the nozzle part N is connected to the detergent chamber 46 through the detergent channel 83 provided at the tank body 42, and the detergent chamber 46 is connected to the discharge port 21 of the air pump 2 through the second air supply channel S2. The second air supply channel S2 includes a first pipe S21 connected to the second channel insertion hole 496 of the chamber opening/closing part 49, and a second pipe S23 configured to surround an outer peripheral surface of the first pipe S21 and supply air discharged from the first pipe S21 to the detergent chamber 46.

The first pipe S21 extends from the second channel insertion hole 496 toward a front surface of the detergent chamber 46 at which the nozzle part N is positioned. The second pipe S23 extends from a surface of the detergent chamber 46 toward the second channel insertion hole 496 so as to accommodate an outer peripheral surface of the first pipe S21 therein. However, the second pipe S23 is not in contact with a rear surface of the detergent chamber 46 (surface at which the chamber opening/closing part 49 is provided). The second air supply channel S2 having a dual pipe structure allows detergent stored in the detergent chamber to move toward the detergent channel 83 regardless of a position of the portable laundry treating apparatus 200.

Accordingly, if air is supplied to the first pipe S21 through the channel valve 3 (refer to FIG. 10*a*), air moves to the rear of the detergent chamber 46 (directed to the chamber opening/closing part 49) through the second pipe S23. If air is supplied to the rear of the detergent chamber 46, detergent is supplied to the detergent discharge pipe 643 of the nozzle part N through the detergent channel 83 provided at the front of the detergent chamber 46, and air in the detergent discharge pipe 643 is sprayed onto a contaminated area of laundry through the detergent discharge hole 625.

As shown in FIG. 12*c*, the suction pipe 647 provided at the nozzle part N is connected to the suction chamber 48 through the suction channel 85, and the suction chamber 48 is connected to the suction port 23 of the air pump 2 through the air suction channel C. The air suction channel C includes a first suction channel C1 inserted into the third channel insertion hole 497 of the chamber opening/closing part 49, and a second suction channel C2 configured to surround an outer peripheral surface of the first suction channel C1 and guide air in the suction chamber 48 to the first suction channel C1.

The first suction channel C1 is configured with a pipe which extends from the third channel insertion hole 497 toward a front surface of the suction chamber 48 at which the nozzle part N is positioned. The second suction channel C2 extends from a front surface of the suction chamber 48 toward the third channel insertion hole 497 so as to accommodate an outer peripheral surface of the first suction channel C1 therein. However, the pipe is not in contact with a rear surface of the suction chamber 48.

The air suction channel C having a dual pipe structure prevents liquid in the suction chamber 48 from moving to the suction port 23 of the air pump 2 regardless of inclination of the portable laundry treating apparatus 200.

If air in the first suction channel C1 moves to the suction port 23 of the air pump 2 through the channel valve 3 (refer to FIGS. 10*b* and 10*c*), air in the suction chamber 48 moves to the second suction channel C2 and accordingly, an internal air pressure of the suction chamber 48 is decreased. If an internal air pressure of the suction chamber 48 is decreased, liquid remaining in a contaminated area of laundry moves to the suction chamber 48 through the suction holes 6271, the suction hole connection channel 6471, the suction pipe 647 and the suction channel 85.

Since the plural suction holes 6271 formed at the first nozzle body 62 are connected to each other through the connection recess 6273, a negative pressure is generated at the connection recess 6273 as well as the suction holes 6271.

The water discharge hole 623 formed at the first nozzle body 62 communicates with the connection recess 6273. Accordingly, liquid remaining in laundry can be removed rapidly through the suction holes 6271, the connection recess 6273 and the water discharge hole 623.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A hand-held laundry treating apparatus comprising:

a portable body;

a supply tank including a tank body provided at the portable body, a water chamber provided in the tank body to store water therein, and a detergent chamber provided in the tank body to store detergent therein;

a suction tank including a suction chamber provided at the portable body to store liquid therein; and a liquid transferring part configured to supply liquid stored in the supply tank to laundry and transfer liquid remaining in laundry to the suction tank;

a supply nozzle communicating with the water chamber and the detergent chamber to guide liquid discharged from the supply tank to laundry; and a suction nozzle communicating with the suction tank to suck liquid remaining in laundry to the suction tank, wherein the liquid transferring part includes:

an air pump provided at the portable body and including a discharge port through which air is discharged and a suction port through which air is sucked;

an air supply channel configured to connect the discharge port and the supply nozzle;

an air suction channel configured to connect the suction port and the suction tank;

a discharge channel configured to connect the water chamber and the detergent chamber to the supply nozzle; and a suction channel configured to connect the suction chamber to the suction nozzle, wherein the supply nozzle includes:

a nozzle body fixed to the supply tank and including a discharge part which communicates with an outside;

a spray body provided at the nozzle body;

a storage part provided in the spray body, into which liquid in the water chamber and the detergent chamber is introduced through the discharge channel;

a chamber provided at the spray body, to which the air supply channel is connected; and a chamber connection pipe configured to transfer liquid in the storage part to the discharge part by connecting the chamber, the discharge part and the storage part to each other and transferring air introduced into the chamber to the discharge part, and wherein the chamber connection pipe further includes a junction part having a cross-sectional area which is gradually decreased, and the discharge part and the storage part are connected to the chamber connection pipe through the junction part.

2. The hand-held laundry treating apparatus according to claim 1, wherein the suction nozzle includes a suction hole which is formed through the nozzle body and to which the suction channel is connected.

3. The hand-held laundry treating apparatus according to claim 1, further comprising:

a vibration part configured to vibrate at least any one of the supply nozzle and the suction nozzle.

4. The hand-held laundry treating apparatus according to claim 1, wherein the liquid transferring part is configured to simultaneously supply liquid stored in the supply tank to laundry and transfer liquid remaining in laundry to the suction tank.

5. The hand-held laundry treating apparatus according to claim 1, wherein the portable body further comprises:

a handle configured to be grasped by a hand of a user, the handle being connected to a liquid storage part; and a nozzle configured to contact laundry, the nozzle being connected to the liquid storage part, wherein the handle, the liquid storage part, and the nozzle are fixed with respect to one another so that movement of the handle in horizontal and vertical directions toward dirt on laundry creates a corresponding movement of the liquid storage part and the nozzle.

6. A hand-held laundry treating apparatus comprising:

a portable body;

a supply tank including a tank body provided at the portable body, a water chamber provided in the tank body to store water therein, and a detergent chamber provided in the tank body to store detergent therein;

a suction tank including a suction chamber provided at the portable body to store liquid therein;

a liquid transferring part configured to supply liquid stored in the supply tank to laundry and transfer liquid remaining in laundry to the suction tank;

a supply nozzle communicating with the water chamber and the detergent chamber to guide liquid discharged from the supply tank to laundry; and a suction nozzle communicating with the suction tank to suck liquid remaining in laundry to the suction tank, wherein the liquid transferring part includes:

an air pump provided at the portable body and including a discharge port through which air is discharged and a suction port through which air is sucked;

an air supply channel configured to connect the discharge port and the supply nozzle;

an air suction channel configured to connect the suction port and the suction tank;

a discharge channel configured to connect the water chamber and the detergent chamber to the supply nozzle; and a suction channel configured to connect the suction chamber to the suction nozzle, and wherein the supply nozzle includes:

a nozzle body fixed to the supply tank and including a discharge part which communicates with an outside;

a spray body provided at the nozzle body;

a storage part provided in the spray body, into which liquid in the water chamber and the detergent chamber is introduced through the discharge channel;

a chamber provided at the spray body, to which the air supply channel is connected; and a chamber connection pipe configured to transfer liquid in the storage part to the discharge part by connecting the chamber, the discharge part and the storage part to each other and transferring air introduced into the chamber to the discharge part.

7. The hand-held laundry treating apparatus according to claim 6, wherein the supply tank includes:

a tank body which is removably coupled to the portable body and to which the nozzle body is fixed;

a first partition wall provided in the tank body to separate the water chamber and the detergent chamber from each other; and a second partition wall provided in the detergent chamber to separate the detergent chamber from a space in which the discharge channel is provided.

8. The hand-held laundry treating apparatus according to claim 7, wherein the suction tank is removably coupled to the nozzle body.

9. The hand-held laundry treating apparatus according to claim 7, further comprising:

a tank valve by which only any one of the water chamber and the detergent chamber communicates with the storage part.

10. The hand-held laundry treating apparatus according to claim 9, wherein the discharge channel includes a detergent discharge hole formed through the second partition wall, a water discharge pipe formed through the first partition wall, through which water in the water chamber is discharged, and a valve accommodation pipe by which the detergent discharge hole and the water discharge pipe communicate with each other, the storage part further includes a connection channel which is connected to the detergent discharge hole, and the tank valve includes a valve body which is inserted into the valve accommodation pipe through the detergent discharge hole and is configured to move reciprocatingly in the valve accommodation pipe, and a channel switching part which is provided at the valve body and allows the detergent discharge hole and the connection channel to communicate with each other or the water discharge pipe and the connection channel to communicate with each other according to a position of the valve body.

11. The hand-held laundry treating apparatus according to claim 10, wherein the channel switching part includes:

a first recess and a second recess which are concavely formed at an outer peripheral surface of the valve body and are spaced apart from each other by a certain distance; and an opening/closing part which is provided between the first recess and the second recess to position the first recess or the second recess at the connection channel according to a position of the valve body, and wherein a valve channel is configured to guide water in the valve accommodation pipe to the second recess.

12. A hand-held laundry treating apparatus comprising:

a portable body;

a supply tank including a tank body provided at the portable body, a water chamber provided in the tank body to store water therein, and a detergent chamber provided in the tank body to store detergent therein;

a suction tank including a suction chamber provided at the portable body to store liquid therein;

a liquid transferring part configured to supply liquid stored in the supply tank to laundry and transfer liquid remaining in laundry to the suction tank;

a supply nozzle communicating with the water chamber and the detergent chamber to guide liquid discharged from the supply tank to laundry;

a suction nozzle communicating with the suction tank to suck liquid remaining in laundry to the suction tank, wherein the liquid transferring part includes:

an air pump provided at the portable body and including a discharge port through which air is discharged and a suction port through which air is sucked;

an air supply channel configured to connect the discharge port and the supply nozzle;

an air suction channel configured to connect the suction port and the suction tank;

a discharge channel configured to connect the water chamber and the detergent chamber to the supply nozzle; and a suction channel configured to connect the suction chamber to the suction nozzle; and a channel valve which is provided at the portable body and is configured to open the air supply channel and the air suction channel at the same time or open only any one of the air supply channel and the air suction channel, wherein the channel valve includes:

a valve support body provided at the portable body;

a support body through-hole formed through the valve support body;

a discharge port connection pipe configured to connect the support body through-hole and the discharge port of the air pump;

a suction port connection pipe configured to connect the support body through-hole and the suction port of the air pump;

a supply channel connection pipe configured to connect the support body through-hole and the air supply channel;

a suction channel connection pipe configured to connect the support body through-hole and the air suction channel; and a valve rotatably provided at the support body through-hole, and wherein the valve allows the supply channel connection pipe and the suction channel connection pipe to respectively communicate with the discharge port connection pipe and the suction port connection pipe or allows only any one of the supply channel connection pipe and the suction channel connection pipe to communicate with only any one of the discharge port connection pipe and the suction port connection pipe according to a rotation angle.

13. The hand-held laundry treating apparatus according to claim 12, wherein the valve includes:

a body rotatably provided at the support body through-hole;

a first body channel communicating with the discharge port connection pipe and extending toward the inside of the body;

a second body channel communicating with the supply channel connection pipe and connected to the first body channel;

a third body channel communicating with the suction port connection pipe and extending toward the inside of the body;

a fourth body channel communicating with the suction channel connection pipe and connected to the third body channel; and a fifth body channel connected to the fourth body channel so as to communicate with the suction channel connection pipe when the body is rotated so that the second body channel and the fourth body channel respectively communicate with the discharge port connection pipe and the suction port connection pipe, and wherein the valve support body further includes a communicating pipe which is connected to the support body through-hole and communicates with the first body channel when the fifth body channel is positioned at the suction channel connection pipe, and a communicating groove which is concavely formed at an outer peripheral surface of the valve support body and by which the communicating pipe communicates with the outside of the portable body.

* * * * *